US008679717B2

(12) United States Patent
Matsuoka et al.

(10) Patent No.: US 8,679,717 B2
(45) Date of Patent: Mar. 25, 2014

(54) BINDER RESIN FOR TONER, TONER AND METHOD FOR PRODUCING THE SAME

(75) Inventors: Hiroshi Matsuoka, Ichihara (JP); Hiroyuki Takei, Kamagaya (JP); Linwood Blanton Muire, III, Chiba (JP)

(73) Assignee: Mitsui Chemicals, Inc., Minato-Ku, Tokyo (JP)

( * ) Notice: Subject to any disclaimer, the term of this patent is extended or adjusted under 35 U.S.C. 154(b) by 0 days.

(21) Appl. No.: 13/813,427

(22) PCT Filed: Jul. 29, 2011

(86) PCT No.: PCT/JP2011/004323

§ 371 (c)(1), (2), (4) Date: Jan. 31, 2013

(87) PCT Pub. No.: WO2012/017635

PCT Pub. Date: Feb. 9, 2012

(65) Prior Publication Data

US 2013/0130166 A1 May 23, 2013

(30) Foreign Application Priority Data

Aug. 5, 2010 (JP) ..... 2010-176788

(51) Int. Cl.
*G03G 9/00* (2006.01)

(52) U.S. Cl.
USPC ..... 430/109.1; 430/109.3; 430/109.4; 430/137.1; 524/513; 524/525

(58) Field of Classification Search
USPC ..... 430/109.1, 109.3, 109.4, 137.1; 524/513, 525
See application file for complete search history.

(56) References Cited

U.S. PATENT DOCUMENTS

| | | | | |
|---|---|---|---|---|
| 7,312,009 | B2 * | 12/2007 | Lee et al. | 430/108.3 |
| 2005/0277046 | A1 | 12/2005 | Sawada et al. | |

FOREIGN PATENT DOCUMENTS

| | | | |
|---|---|---|---|
| JP | 3-221966 | A | 9/1991 |
| JP | 2872347 | B2 | 3/1999 |
| JP | 2931899 | B1 | 8/1999 |
| JP | 2002-258530 | A | 9/2002 |
| JP | 2003-215845 | A | 7/2003 |
| JP | 2004-046095 | A | 2/2004 |
| JP | 3532033 | B2 | 5/2004 |
| JP | 2004-309517 | A | 11/2004 |
| JP | 2006-171364 | A | 6/2006 |
| JP | 3794762 | B2 | 7/2006 |
| JP | 2007-071993 | A | 3/2007 |
| JP | 2007-127828 | A | 5/2007 |
| JP | 3971228 | B2 | 9/2007 |
| JP | 2008-102390 | A | 5/2008 |

OTHER PUBLICATIONS

International Search Report (PCT/ISA/210) issued on Sep. 20, 2011, by the Japanese Patent Office as the International Searching Authority for International Application No. PCT/JP2011/004323.

* cited by examiner

*Primary Examiner* — Thorl Chea
(74) *Attorney, Agent, or Firm* — Buchanan Ingersoll & Rooney PC

(57) ABSTRACT

A binder resin for a toner containing a vinyl resin (A), a non-crystalline polyester resin (SN) and a saturated crystalline polyester resin (SC), in which the content of the vinyl resin (A) is equal to or more than 65 mass % and equal to or less than 95 mass %, based on the total content of 100 mass % of (A), (SN) and (SC), (A) is composed of a carboxyl group-containing vinyl resin (C), a glycidyl group-containing vinyl resin (E) and a reaction product of the vinyl resins, the ester group concentration of (SC) is equal to or more than 10.0 mmol/g and equal to or less than 13.5 mmol/g, (SN) is dispersed in an island form in (A) and (SC) is contained in the island phase of (SN), and the metal component (M) containing at least one kind selected from the group consisting of Zn, Ca, Mg, Al and Ba (excluding metal oxide) is contained at least in (SC).

14 Claims, No Drawings

BINDER RESIN FOR TONER, TONER AND METHOD FOR PRODUCING THE SAME

TECHNICAL FIELD

The present invention relates to a binder resin for a toner, a toner and a method for producing the same.

BACKGROUND ART

In general, an electrophotography in a PPC (Plain Paper Copy) copier or a printer for transferring a toner image formed on a photo-sensitive material to recording paper is carried out in the procedure described below. First, an electrostatic latent image is formed on the photo-sensitive material, the latent image is developed by using a toner, the toner image is transferred onto a sheet to be fixed such as paper or the like, and then the transferred toner image is fixed by heating with a heat roll or a film. Since the fixation is carried out under heating in a state that the heat roll or the film is directly brought into contact with the toner on the sheet to be fixed according to this method, it is performed in a short period of time and with a very high thermal efficiency, thereby achieving a very good fixing efficiency.

However, though having a good thermal efficiency, the heat fixing method has a problem of a so-called offset phenomenon since the toner is brought into contact with the surface of the heat roll or the film in the melt state of the toner. With fast printing speed, so-called low temperature fixing performance for fixing at lower temperatures has been in demand for a toner.

In order to obtain a resin excellent in fixing properties and offset resistance, there has been known a resin obtained by using a high molecular weight resin and a low molecular weight resin in mixture and crosslinking a high molecular weight portion (for example, Patent Documents 1 and 2). However, sufficient low temperature fixing performance could not be obtained from these resins. Meanwhile, for the purpose of improving low temperature fixing properties, there has been disclosed a resin obtained by the addition of a different kind of resin such as crystalline polyester or the like to a base resin such as a styrene acrylic resin or the like (for example, Patent Documents 3 and 4). However, only with the addition, dispersibility of the crystalline polyester was low, and crystalline polyester was easily detached when it was used for a toner. With the addition of crystalline polyester, low temperature fixing properties were enhanced, but blocking was easily caused by the detached crystalline polyester, so that satisfactory storage stability has not been achieved.

There has been disclosed a resin in which a crystalline polyester resin was added to a base resin and both resins were chemically combined (for example, Patent Documents 5 to 7). However, since both resins were chemically combined, the crystalline polyester resin was melted in the base resin, the base resin was plasticized, and crystallinity of the crystalline polyester resin was reduced, so that satisfactory storage stability has not been achieved.

Meanwhile, the addition of a non-crystalline resin, an inorganic fine particle or an organic metal salt to a crystalline polyester resin has been disclosed in various documents (for example, Patent Documents 8 and 9). According to these documents, crystallinity was controlled with the addition of an inorganic fine particle or an organic metal salt, but it was difficult to increase the degree of crystallinity of the crystalline polyester when the compatibility between the crystalline polyester resin and the non-crystalline rosin was not controlled. As a result, satisfactory storage stability has not been achieved.

Meanwhile, in paragraph 0076 of Patent Document 10, when the toner of the present invention is produced according to a suspension polymerization method (to be described later), non-crystalline polyester is easily unevenly distributed on the surface of suspension droplets formed in an aqueous dispersion medium and as a result, non-crystalline polyester is unevenly distributed on the surface of toner particles of the toner to be produced. On the other hand, according to the document, crystalline polyester is unevenly distributed inside toner particles. Namely, according to the document, in the suspension polymerization method, crystalline polyester is present inside the toner, and non-crystalline polyester is present on the toner surface, so that it is found that the surface layer of the crystalline polyester is not coated with non-crystalline polyester.

RELATED DOCUMENT

Patent Document

Patent Document 1: Japanese Patent No. 3532033
Patent Document 2: Japanese Patent No. 3794762
Patent Document 3: Japanese Patent No. 2931899
Patent Document 4: Japanese Laid-open Patent Publication No. 2006-171364
Patent Document 5: Japanese Patent No. 3971228
Patent Document 6: Japanese Patent No. 2872347
Patent Document 7: Japanese Laid-open Patent Publication No. 2008-102390
Patent Document 8: Japanese Laid-open Patent Publication No. 2004-309517
Patent Document 9: Japanese Laid-open Patent Publication No. 2007-127828
Patent Document 10: Japanese Laid-open Patent Publication No. 2007-71993

DISCLOSURE OF THE INVENTION

The present inventors have conducted an extensive study with attention to storage stability of a toner containing crystalline polyester and as a result, have found a binder resin for a toner and a toner excellent in a balance among low temperature fixing properties, offset resistance and storage stability. Thus, the present invention has been completed.

That is, the present invention is specified by matters described in below:

[1] A binder resin for a toner containing a vinyl resin (A), a non-crystalline polyester resin (SN), a saturated crystalline polyester resin (SC), and a metal component (M) containing at least one kind selected from the group consisting of Zn, Ca, Mg, Al and Ba (however, excluding metal oxide), wherein the content of the vinyl resin (A) is equal to or more than 65 mass % and equal to or less than 95 mass %, based on the total content of 100 mass % of the vinyl resin (A), the non-crystalline polyester resin (SN) and the saturated crystalline polyester resin (SC), the vinyl resin (A) is composed of a carboxyl group-containing vinyl resin (C), a glycidyl group-containing vinyl resin (E) and a reaction product of the vinyl resins, the ester group concentration of the saturated crystalline polyester resin (SC) is equal to or more than 10.0 mmol/g and equal to or less than 13.5 mmol/g, the non-crystalline polyester resin (SN) is dispersed in an island form in the vinyl resin (A) and the saturated crystalline polyester resin (SC) is contained in the island phase of the non-crystalline polyester resin (SN), and the metal component (M) is contained at least in the saturated crystalline polyester resin (SC).

[2] The binder resin for a toner according to [1], wherein the non-crystalline polyester resin (SN) has at least an aromatic ring structure.

[3] The binder resin for a toner according to [1] or [2], wherein the melting point of the saturated crystalline polyester resin (SC) is equal to or more than 75 degrees centigrade and equal to or less than 120 degrees centigrade.

[4] The binder resin for a toner according to any one of [1] to [3], wherein the glass transition temperature is equal to or more than 50 degrees centigrade and equal to or less than 65 degrees centigrade, the tetrahydrofuran soluble content has a main peak in the molecular weight region of equal to or more than $0.3\times10^4$ and less than $2.0\times10^4$ in the molecular weight distribution measured by gel permeation chromatography, and the tetrahydrofuran insoluble content is equal to or more than 5 mass % and less than 40 mass %.

[5] The binder resin for a toner according to any one of [1] to [4], wherein the acid value of the saturated crystalline polyester resin (SC) is equal to or more than 25 mgKOH/g and equal to or less than 70 mgKOH/g.

[6] The binder resin for a toner according to any one of [1] to [5], wherein the content of the non-crystalline polyester resin (SN) is equal to or more than 15 mass % and equal to or less than 70 mass %, based on the total content of 100 mass % of the non-crystalline polyester resin (SN) and the saturated crystalline polyester resin (SC).

[7] The binder resin for a toner according to any one of [1] to [6], wherein, for the non-crystalline polyester resin (SN), the ester group concentration is equal to or more than 3.0 mmol/g and equal to or less than 7.0 mmol/g, the acid value is equal to or more than 25 mgKOH/g and equal to or less than 70 mgKOH/g, and the tetrahydrofuran soluble content has a main peak in the molecular weight region of equal to or more than $0.3\times10^4$ and less than $1.0\times10^4$ in the molecular weight distribution measured by gel permeation chromatography.

[8] The binder resin for a toner according to any one of [1] to [7], wherein the phase of the saturated crystalline polyester resin (SC) is contained in the phase of the non-crystalline polyester resin (SN).

[9] The binder resin for a toner according to any one [1] to [8], wherein the metal component (M) is derived from a fatty acid metal salt represented by the following general formula, $$(C_nH_{2n+1}COO)_m\text{-}M$$

wherein n is an integer of 11 to 22; m is an integer of 2 or 3; and M is a metal selected from Zn, Ca, Mg, Al and Ba.

[10] A toner containing a binder resin for a toner, a coloring agent and a releasing agent, wherein the binder resin for a toner is the binder resin for a toner according to any one of [1] to [9], at least one of the releasing agents has a melting point of equal to or more than −40 degrees centigrade and equal to or less than 5 degrees centigrade, based on the melting point of the saturated crystalline polyester resin (SC), and the dispersion diameter of the island phase of the non-crystalline polyester resin (SN) in the vinyl resin (A) is equal to or less than 2.0 μm.

[11] The toner according to [10], wherein the glass transition temperature is equal to or more than 50 degrees centigrade and equal to or less than 65 degrees centigrade, the tetrahydrofuran soluble content has a main peak in the molecular weight region of equal to or more than $0.3\times10^4$ and less than $2\times10^4$ in the molecular weight distribution measured by gel permeation chromatography, and the tetrahydrofuran insoluble content is equal to or more than 5 mass % and less than 40 mass %.

[12] A method for producing a binder resin for a toner involving:

obtaining a mixture of a non-crystalline polyester resin (SN), a saturated crystalline polyester resin (SC) and a metal component (M) containing at least one kind selected from the group consisting of Zn, Ca, Mg, Al and Ba (however, excluding metal oxide), and mixing the obtained mixture, a carboxyl group-containing vinyl resin (C) and a glycidyl group-containing vinyl resin (E) in the melt state.

[13] A method for producing a toner involving:

obtaining a binder resin for a toner, and mixing the binder resin for a toner and a coloring agent, in which the binder resin for a toner is obtained in accordance with the production method according to [12].

Effect of the Invention

According to the present invention, there are provided a binder resin for a toner and a toner excellent in low temperature fixing properties, offset resistance and storage stability.

DESCRIPTION OF EMBODIMENTS

The present invention will be described in more detail below.

In the present invention, the term "polymerization" may include the meaning of copolymerization, and the term "polymer" may have the meaning of a copolymer. Furthermore, "to" may include both the upper limit and the lower limit otherwise specifically mentioned.

The binder resin for a toner of the present invention contains a vinyl resin (A), a non-crystalline polyester resin (SN) and a saturated crystalline polyester resin (SC). The content of the vinyl resin (A) is equal to or more than 65 mass % and equal to or less than 95 mass %, based on the total content of 100 mass % of the vinyl resin (A), the non-crystalline polyester resin (SN) and the saturated crystalline polyester resin (SC). The vinyl resin (A) is composed of a carboxyl group-containing vinyl resin (C), a glycidyl group-containing vinyl resin (E) and a reaction product of the vinyl resins. The ester group concentration of the saturated crystalline polyester resin (SC) is equal to or more than 10.0 mmol/g and equal to or less than 13.5 mmol/g. The non-crystalline polyester resin (SN) is dispersed in an island form in the vinyl resin (A) and the saturated crystalline polyester resin (SC) is contained in the island phase of the non-crystalline polyester resin (SN). The metal component (M) containing at least one kind selected from the group consisting of Zn, Ca, Mg, Al and Ba (however, excluding metal oxide) is contained at least in the saturated crystalline polyester resin (SC).

Hereinafter, respective components of the binder resin for a toner will be described.

<Vinyl Resin (A)>

The vinyl resin (A) according to the present invention is composed of a carboxyl group-containing vinyl resin (C), a glycidyl group-containing vinyl resin (E) and a reaction product of the vinyl resins. By such a configuration, there can be obtained a toner excellent in a balance between fixing properties and offset resistance. Furthermore, there can be obtained a toner excellent in dispersibility of the island phase of the non-crystalline polyester resin (SN) in the toner. Accordingly, there can be obtained a toner excellent in storage stability and durability.

The ester group concentration of the vinyl resin (A) is preferably equal to or more than 0.6 mmol/g and equal to or less than 2.9 mmol/g, and more preferably equal to or more than 1.0 mmol/g and equal to or less than 2.5 mmol/g. Thus, dissolution of the saturated crystalline polyester resin (SC) in the vinyl resin (A) is inhibited and dispersibility of the island phase of the non-crystalline polyester resin (SN) is improved, so that a toner excellent in storage stability is obtained. The ester group concentration of the vinyl resin (A) is derived from an ester group contained in a (meth)acrylic monomer or the like contained in the vinyl resin (A), and is calculated from composition of monomers in the production of the vinyl resin (A). Or, the ester group concentration is also calculated from composition of monomers of the vinyl resin (A) analyzed by pyrolysis GC (pyrolysis gas chromatography).

<Carboxyl Group-containing Vinyl Resin (C)>

The acid value of the carboxyl group-containing vinyl resin (C) according to the present invention is preferably from 3 to 25 mgKOH/g, more preferably from 3 to 20 mgKOH/g, and further preferably from 4 to 18 mgKOH/g. When the acid value of the carboxyl group-containing vinyl resin (C) is lower than 3 mgKOH/g, the reaction with the glycidyl group-containing vinyl resin (E) to be described below hardly proceeds and as a result, deterioration of offset resistance easily occurs when it is used for a toner. On the other hand, when the acid value of the carboxyl group-containing vinyl resin (C) exceeds 25 mgKOH/g, the reaction with the glycidyl group-containing vinyl resin (E) proceeds too far, the crosslinking component obtained by the reaction of the carboxyl group-containing vinyl resin (C) with the glycidyl group-containing vinyl resin (E) is excessively phase-separated from the non-crosslinking component, and deterioration of offset resistance which is considered to be caused by the crosslinking component having no effect on offset resistance occurs in some cases. Incidentally, in the present invention, the acid value refers to mg of potassium hydroxide necessary to neutralize 1 g of the resin.

It is preferable that the carboxyl group-containing vinyl resin (C) contains a high molecular weight vinyl resin (H) in which the tetrahydrofuran (hereinafter referred to as THF) soluble content has a peak in the molecular weight region of equal to or more than $10\times10^4$ and less than $35\times10^4$ in the chromatogram obtained by gel permeation chromatography (hereinafter referred to as GPC) and a low molecular weight vinyl resin (L) in which the THF soluble content has a peak in the molecular weight region of equal to or more than $0.3\times10^4$ and less than $2.0\times10^4$ in the chromatogram obtained by GPC. The term "peak" mentioned herein indicates a main peak (peak having the highest strength among the peaks).

When the carboxyl group-containing vinyl resin (C) is composed of the high molecular weight vinyl resin (H) and the low molecular weight vinyl resin (L), the ratio (H/L) is preferably from 10/90 to 50/50 from the viewpoint of an overall balance among fixing properties, offset resistance and durability of the toner. The ratio (H/L) is more preferably from 10/90 to 45/55. When the content of the high molecular weight vinyl resin (H) is lower than 10 mass %, based on the total content of 100 mass % of the high molecular weight vinyl resin (H) and the low molecular weight vinyl resin (L), durability and offset resistance are worsened in some cases when it is used for a toner. On the other hand, when the content of the high molecular weight vinyl resin (H) exceeds 50 mass %, fixing properties of the toner are worsened in some cases.

Examples of the monomer constituting the carboxyl group-containing vinyl resin (C) include styrene monomers, acrylic monomers (including methacrylic monomers as well; hereinafter the same), in addition to the carboxyl group-containing monomers (here, the styrene monomer is a monomer having a styrene skeleton and the acrylic monomer is a monomer having an acrylic skeleton).

Examples of the styrene monomer to be used in the present invention include styrene, p-methylstyrene, m-methylstyrene, o-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene and the like. Particularly preferably used is styrene.

Examples of the acrylic monomer to be used in the present invention include acrylic esters such as methyl acrylate, ethyl acrylate, propyl acrylate, butyl acrylate, octyl acrylate, cyclohexyl acrylate, stearyl acrylate, benzyl acrylate, furfuryl acrylate, hydroxyethyl acrylate, hydroxybutyl acrylate, dimethylaminomethyl acrylate, dimethylaminoethyl acrylate and the like; methacrylic esters such as methyl methacrylate, ethyl methacrylate, propyl methacrylate, butyl methacrylate, octyl methacrylate, cyclohexyl methacrylate, stearyl methacrylate, benzyl methacrylate, furfuryl methacrylate, hydroxyethyl methacrylate, hydroxybutyl methacrylate, dimethylaminomethyl methacrylate, dimethylaminoethyl methacrylate and the like; amides such as acrylamide, methacrylamide, N-substituted acrylamide, N-substituted methacrylamide and the like; acrylonitrile; and methacrylonitrile. Among these, preferably used are acrylic esters, methacrylic esters, acrylonitrile and methacrylonitrile. Particularly preferably used are butyl acrylate, methyl methacrylate, butyl methacrylate and hydroxyethyl acrylate.

In the present invention, in addition to the aforementioned monomers, there may also be used diesters of unsaturated dibasic acids such as dimethyl fumarate, dibutyl fumarate, dioctyl fumarate, dimethyl maleate, dibutyl maleate, dioctyl maleate and the like as monomers.

Examples of the carboxyl group-containing monomer in the present invention include acrylic acid, methacrylic acid, maleic acid anhydride, maleic acid, fumaric acid, cinnamic acid, mono esters of unsaturated dibasic acids such as methyl fumarate, ethyl fumarate, propyl fumarate, butyl fumarate, octyl fumarate, methyl maleate, ethyl maleate, propyl maleate, butyl maleate, octyl maleate and the like. Preferably used are acrylic acid, methacrylic acid, fumaric acid, methyl fumarate, ethyl fumarate, propyl fumarate, butyl fumarate and octyl fumarate, and particularly preferably used are acrylic acid and methacrylic acid.

For the carboxyl group-containing vinyl resin (C) in the present invention, a crosslinkable monomer having two or more double bonds may be used, as necessary, as a monomer. Examples of the crosslinkable monomer include aromatic divinyl compounds such as divinyl benzene, divinyl naphthalene and the like; diacrylate compounds and methacrylate compounds thereof such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyoxyethylene(2)-2,2-bis(4-hydroxyphenyl)propane diacrylate, polyoxyethylene(4)-2,2-bis(4-hydroxyphenyl)propane diacrylate and the like; and polyfunctional crosslinkable monomers and methacrylate compounds thereof such as pentaerythritol triacrylate, trimethylolethane triacrylate, trimethylolpropane triacrylate, tetramethylolmethane tetraacrylate and the like.

When these polyfunctional crosslinkable monomers are used, the crosslinkable monomer is preferably contained in an amount of less than 0.5 mass %, based on 100 mass % of monomers other than the carboxyl group-containing vinyl resin (C). When the amount is equal to or more than 0.5 mass %, a crosslinked body created by the reaction of a carboxyl group with a glycidyl group to be described below is cut in the production of a toner in some cases. The reason is considered that the crosslinked portion is brittle to kneading shear in the production of a toner due to the polyfunctional crosslinkable monomer so that the crosslinked body is cut, and starting from the cut crosslinked portion due to the polyfunctional crosslinkable monomer, scission of other crosslinked portions is accelerated.

As a method for producing the carboxyl group-containing vinyl resin (C) according to the present invention, there can be adopted any of known polymerization methods such as solution polymerization, bulk polymerization, suspension polymerization, emulsion polymerization and the like, or a combination thereof. Solution polymerization, bulk polymerization and the combination of solution polymerization and bulk polymerization are suitably adopted from the viewpoints of adjustment of the molecular weight distribution, mixing properties of the high molecular weight vinyl resin (H) and the low molecular weight vinyl resin (L) to be described later, and convenience of distribution adjustment of the carboxyl group and the glycidyl group.

The carboxyl group-containing vinyl resin (C) according to the present invention can be obtained by polymerizing each of the high molecular weight vinyl resin (H) and the low molecular weight vinyl resin (L) alone in advance, and then mixing these resins in the melt state or the solution state. Furthermore, it can also be obtained by polymerizing any one of the high molecular weight vinyl resin (H) or the low molecular weight vinyl resin (L) alone, and then polymerizing the other vinyl resin in the presence of the former vinyl resin.

Examples of the solvent used for solution polymerization include aromatic hydrocarbon solvents such as benzene, toluene, ethylbenzene, xylene, cumene and the like. These solvents may be used singly or a mixture thereof may be used, and preferably used is xylene.

Polymerization may be carried out by using a polymerization initiator or so-called thermal polymerization may be carried out without using a polymerization initiator. As the polymerization initiator, any polymerization initiators may be usually used as far as they may be used as radical polymerization initiators. Examples thereof include azo initiators such as 2,2'-azobisisobutyronitrile, 2,2'-azobis(4-methoxy-2,4-dimethylvaleronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methyl-propane) and the like; ketone peroxides such as methylethylketone peroxide, acetylacetone peroxide, cyclohexanone peroxide and the like; peroxy ketals such as 1,1-bis(t-butylperoxy)-3,3,5-trimethylcyclohexane, 1,1-bis(butylperoxy)cyclohexane, 2,2-bis(t-butylperoxy)butane and the like; hydroperoxides such as t-butyl hydroperoxide, cumene hydroperoxide, 1,1,3,3-tetramethylbutyl hydroperoxide and the like; dialkyl peroxides such as di-t-butyl peroxide, t-butylcumyl peroxide, dicumyl peroxide, 2,5-dimethyl-2,5-di(t-butylperoxy)hexane, α,α'-bis(t-butylperoxyisopropyl)benzene and the like; diacyl peroxides such as isobutyryl peroxide, octanoyl peroxide, decanoyl peroxide, lauroyl peroxide, 3,5,5-trimethylhexanoyl peroxide, benzoyl peroxide, m-toluoyl peroxide and the like; peroxydicarbonates such as diisopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl)peroxydicarbonate and the like; sulfonyl peroxides such as acetylcyclohexyl sulfonyl peroxide and the like; and peroxyesters such as t-butyl peroxyacetate, t-butyl peroxyisobutyrate, t-butyl peroxyneodecanoate, cumyl peroxyneodecanoate, t-butyl peroxy-2-ethyl hexanoate, t-butyl peroxylaurate, t-butyl peroxybenzoate, t-butyl peroxyisopropylcarbonate, di-t-butyl diperoxyisophthalate and the like. These initiators may be used singly or in combination of two or more kinds.

The type and amount of the polymerization initiator may be properly selected depending on the reaction temperature, concentration of the monomer and the like. The polymerization initiator is usually used in an amount of 0.01 to 10 mass % per 100 mass % of the monomer in use.

Meanwhile, the carboxyl group-containing vinyl resin (C) may further contain a block copolymer consisting of a block including a sequence of ethylenic hydrocarbon-derived constituent units and/or conjugated diene hydrocarbon-derived constituent units and a block including a sequence of styrene-derived constituent units, and/or a hydrogenated block copolymer, that is, a hydrogenated product of the block copolymer.

The content of the block copolymer and hydrogenated block copolymer is preferably equal to or more than 0.05 mass % and equal to or less than 1.5 mass %, and more preferably equal to or more than 0.1 mass % and equal to or less than 1.0 mass %, based on 100 mass % of the carboxyl group-containing vinyl resin (C). When the content is within the above range, the releasing agent can be dispersed in the binder resin for a toner without impairing storage stability and fluidity of the toner. Therefore, a toner excellent in stain resistance on the photo-sensitive material is easily achieved.

In order to obtain these block copolymers, there may generally be used one or more kinds selected from ethylenic hydrocarbons such as ethylene, propylene, 1-butene, 2-butene, isobutylene, 1-pentene, 2-pentene, 2-methyl-1-butene, 3-methyl-1-butene, 2-methyl-2-butene, 1-hexene, 2,3-dimethyl-2-butene or the like, and conjugated diene hydrocarbons such as butadiene, isoprene or the like. The block copolymer is produced by a method involving using a reactive group of a block copolymer obtained in accordance with a known living anionic polymerization or a living cationic polymerization, and then blocking this reactive group with styrene. However, the production method is not restricted thereto and other conventionally known methods may also be employed. In addition, some kinds of the aforementioned block copolymers have unsaturated double bonds; at that time, the block copolymer may be used as a hydrogenated product obtained by reacting the unsaturated double bonds of the block copolymer with hydrogen in accordance with a known process.

Examples of a commercial product used for the aforementioned block copolymer include Kraton (styrene-ethylene/butylene-styrene block copolymer (SEBS), styrene-butadiene-styrene block copolymer, styrene-isoprene-styrene block copolymer, styrene-ethylene/propylene-styrene block copolymer or styrene-ethylene/propylene block copolymer) produced by Kraton Performance Polymers.Inc., Septon (styrene-ethylene/propylene block copolymer or hydrogenated styrene-isoprene block copolymer) produced by Kuraray Co., Ltd., Tufprene (styrene-butadiene block copolymer) produced by Asahi Kasei Co., Ltd., and the like.

<High Molecular Weight Vinyl Resin (H)>

The high molecular weight vinyl resin (H) according to the present invention contains the THF soluble content which has a main peak in the molecular weight region of equal to or more than $10\times10^4$ and less than $35\times10^4$, and more preferably equal to or more than $15\times10^4$ and less than $30\times10^4$ in the chromatogram obtained by GPC. Thus, there is obtained a toner in which an excellent balance among fixing properties, offset resistance and durability is realized. When the molecular weight of the main peak of the high molecular weight vinyl resin (H) (hereinafter referred to as the peak molecular weight) is less than $10\times10^4$, strength of the binder resin for a toner is not sufficient, and durability of the toner to be obtained is worsened. Furthermore, in the formation of a crosslinked body by the reaction with the glycidyl group to be described below, the formation of the crosslinked body is not sufficiently achieved and offset resistance is worsened in some cases. On the other hand, when the above peak molecular weight is equal to or more than $35\times10^4$, the viscosity of the binder resin is easily increased by the reaction with the glycidyl group-containing vinyl resin, but unreacted high molecular weight vinyl resin easily remains in large quantities when adjusted to the proper range of the viscoelasticity of the toner, and unreacted high molecular weight vinyl resin causes deterioration of fixing properties in some cases.

The acid value (AVH) of the high molecular weight vinyl resin (H) is preferably from 3 to 30 mgKOH/g and more preferably from 5 to 28 mgKOH/g. Thus, fixing properties and offset resistance of the toner are excellent. When the above acid value is lower than 3 mgKOH/g, the reaction with the glycidyl group-containing vinyl resin to be described later hardly takes place and offset resistance of the toner is worsened in some cases. On the other hand, when the above acid value exceeds 30 mgKOH/g, the reaction with the glycidyl group-containing vinyl resin excessively takes place and the viscosity of the binder resin is excessively increased and as a result, the loss modulus in the fixing temperature region of the toner becomes excessively high and fixing performance is worsened in some cases.

The high molecular weight vinyl resin (H) may not necessarily be a single polymer, and two or more high molecular weight vinyl resins may be used. In this case, the high molecular weight vinyl resin (H) may preferably satisfy the above properties as a whole. Furthermore, to produce a single polymer of the high molecular weight vinyl resin (H), the carboxyl group-containing monomer can be added in the middle of polymerization or added separately at the beginning and end of polymerization.

<Low Molecular Weight Vinyl Resin (L)>

The low molecular weight vinyl resin (L) according to the present invention contains the THF soluble content which has a main peak in the molecular weight region of preferably equal to or more than $0.3\times10^4$ and less than $2.0\times10^4$, and more preferably equal to or more than $0.4\times10^4$ and less than $2\times10^4$ in the chromatogram obtained by GPC. Thus, excellent fixing properties of the toner of the present invention are achieved. When the peak molecular weight of the low molecular weight vinyl resin (L) is less than $0.3\times10^4$, storage stability and durability of the toner are easily adversely affected in some cases. On the other hand, when the above peak molecular weight is equal to or more than $2.0\times10^4$, fixing performance is worsened in some cases.

The acid value (AVL) of the low molecular weight vinyl resin (L) is preferably from 2 to 20 mgKOH/g and more preferably from 3 to 18 mgKOH/g. Thus, there is obtained a toner excellent in fixing performance and offset resistance performance. When the above acid value (AVL) is lower than 2 mgKOH/g, the compatibility with the high molecular weight vinyl resin (H) is extremely worsened and deterioration of durability or very fine offset occurs in some cases. On the other hand, when the above acid value (AVL) is higher than 20 mgKOH/g, increased reactivity with the glycidyl group-containing vinyl resin (E) substantially hinders the reaction of the glycidyl group-containing vinyl resin (E) with the high molecular weight vinyl resin (H), and the low molecular weight vinyl resin (L) itself becomes a high molecular weight resin, thus deteriorating offset resistance or deteriorating fixing properties in some cases.

The low molecular weight vinyl resin (L) necessarily has the above characteristics, but it may not necessarily be a single polymer, and two or more low molecular weight vinyl resins may be used. In this case, the low molecular weight vinyl resin (L) may preferably satisfy the aforementioned characteristics as a whole. Furthermore, to produce a single polymer of the low molecular weight vinyl resin (L), the carboxyl group-containing monomer can be added in the middle of polymerization or added separately at the beginning and end of polymerization.

<Glycidyl Group-containing Vinyl Resin (E)>

The glycidyl group-containing vinyl resin (E) according to the present invention is obtained in accordance with a known polymerization method involving employing at least one of styrene monomers or acrylic monomers (including methacrylic monomers) and at least one of glycidyl group-containing monomers.

In the present invention, examples of the styrene monomers and acrylic monomers (including methacrylic monomers) include monomers exemplified in the carboxyl group-containing vinyl resin (C).

Examples of the glycidyl group-containing monomer in the present invention include glycidyl acrylate, β-methyl glycidyl acrylate, glycidyl methacrylate, β-methyl glycidyl methacrylate and the like, and preferably used are glycidyl methacrylate and β-methyl glycidyl methacrylate.

For the glycidyl group-containing vinyl resin (E) according to the present invention, the THF soluble content has a peak in the molecular weight region of preferably equal to or more than $3\times10^4$ and equal to or less than $7\times10^4$, and more preferably equal to or more than $3\times10^4$ and equal to or less than $6\times10^4$ in the chromatogram obtained by GPC. Furthermore, the epoxy value is preferably from 0.003 to 0.100 Eq/100 g, and more preferably from 0.003 to 0.080 Eq/100 g. When the glycidyl group-containing vinyl resin (E) has the peak molecular weight and the epoxy value in the above ranges, durability of the toner becomes excellent and so-called feature of maintaining development is enhanced. Herein, the feature of maintaining development refers to a feature of a printed image quality which is not reduced by toner breakdown during continuous printing over a long period of time. Furthermore, at the same time, by the reaction of the carboxyl group-containing vinyl resin (C) with the glycidyl group-containing vinyl resin (E), the molecular weight of the high molecular weight component is further increased and appropriate elasticity is imparted to the binder resin, so that offset resistance performance becomes excellent. When the peak molecular weight is excessively low or the epoxy value is excessively low, the elasticity of the binder resin is not sufficient, so that offset resistance becomes worsened in some cases. On the other hand, when the peak molecular weight is excessively high or the epoxy value is excessively high, the elasticity of the binder resin becomes excessively high, so that fixing properties are worsened in some cases.

In the present invention, the epoxy value refers to mole of the epoxy group present in 100 g of the resin, and it can be measured in accordance with JIS K-7236.

The glycidyl group-containing vinyl resin (E) may not necessarily be a single polymer, and two or more glycidyl group-containing vinyl resins may be used. In this case, the glycidyl group-containing vinyl resins (E) preferably satisfy the above characteristics as a whole. Furthermore, to produce a single polymer of the glycidyl group-containing vinyl resin (E), the glycidyl group-containing monomer can be added in the middle of polymerization or added separately at the beginning and end of polymerization.

<Saturated Crystalline Polyester Resin (SC)>

It is preferable that the saturated crystalline polyester resin (SC) according to the present invention is obtained by subjecting an alcohol component selected from aliphatic diols having 2 to 4 carbon atoms and a carboxylic acid component selected from aliphatic dicarboxylic acids having 4 to 6 carbon atoms to polycondensation. When the carbon number of the alcohol component or the carboxylic acid component mentioned above is higher than the above range, hydrophobic properties of the saturated crystalline polyester resin (SC) are increased and as a result, the affinity with the vinyl resin (A) is increased, and the saturated crystalline polyester resin (SC) is dissolved in the vinyl resin (A), the entire binder resin for a toner is plasticized and as a result, storage stability of the toner is lowered in some cases.

Examples of the alcohol component selected from aliphatic diols having 2 to 4 carbon atoms include ethylene glycol, 1,4-butanediol and the like. Furthermore, examples of the carboxylic acid component selected from aliphatic dicarboxylic acids having 4 to 6 carbon atoms include succinic acid, adipic acid, and their acid anhydrides or alkyl ester.

It is preferable that the saturated crystalline polyester resin (SC) according to the present invention does not contain tri- or higher polyhydric alcohol, tri- or higher polycarboxylic acid and acid anhydrides thereof as the raw material alcohol component and carboxylic acid component. When they are contained, a branched structure or a crosslinked structure is formed and crystallization tends to be inhibited, whereby the amount of the non-crystalline portion of the saturated crystalline polyester resin (SC) is increased. As a result, the toner becomes sticky and storage stability is lowered in some cases.

Meanwhile, it is preferable that the saturated crystalline polyester resin (SC) according to the present invention does not contain a carboxylic acid component having a double bond typically represented by fumaric acid and an alcohol component having a double bond as the raw material alcohol component and carboxylic acid component. When the carboxylic acid component having a double bond typically represented by fumaric acid is used, the regularity of the structure is disturbed, a crystal structure of the crystalline polyester resin is hardly formed, and the proportion of the non-crystalline portion causing stickiness of the toner is increased in some cases. As a result, storage stability of the toner tends to be lowered in some cases. Furthermore, a polyester resin having an unsaturated bond may easily be subjected to a radical polymerization during polycondensation, which easily causes formation of a branched structure or a crosslinked structure in the crystalline polyester resin. This is also considered as one reason to make it difficult to form a crystal structure. When the crystalline polyester resin has an unsaturated bond derived from fumaric acid or the like, the affinity of the crystalline polyester resin and the non-crystalline polyester resin (SN) becomes strong, and the crystalline polyester resin tends to be dissolved in the non-crystalline polyester resin (SN). As a result, a crystal structure derived from the crystalline polyester resin is not formed in the island phase of the non-crystalline polyester resin (SN) and the non-crystalline polyester resin is plasticized, whereby storage stability is lowered in some cases.

The temperature for carrying out a polycondensation reaction of the saturated crystalline polyester resin (SC) is generally preferably from 120 to 250 degrees centigrade, more preferably from 130 to 240 degrees centigrade, and further preferably from 140 to 230 degrees centigrade. When the reaction temperature is less than 120 degrees centigrade, the reaction time is increased so that the productivity is lowered in some cases. When the reaction temperature exceeds 250 degrees centigrade, decomposition of the binder resin for a toner occurs in some cases.

In the polycondensation reaction, the addition of a catalyst is preferable because the reaction proceeds rapidly. As the catalyst, known catalysts for use in the polycondensation reaction may be used. Examples thereof include catalysts containing elements such as tin, antimony, titanium, germanium, aluminum and the like. Examples of the catalyst containing tin include dibutyltin oxide and the like. Examples of the catalyst containing antimony include antimony trioxide and the like. As the catalyst containing titanium, further preferably used are titanium alkoxide, titanium acylate, titanium chelate and the like, and particularly preferably used are tetra-n-butyl titanate, tetra(2-ethylhexyl)titanate, tetramethyl titanate and tetraisopropyl titanate. Examples of the catalyst containing germanium include germanium dioxide and the like.

Specific product names of those corresponding to the aforementioned catalysts containing titanium include, though not restricted to, Orgatics TA-25 (tetra-n-butyl titanate), TA-30 (tetra(2-ethylhexyl)titanate), TA-70 (tetramethyl titanate) and the like as titanium alkoxide; Orgatics TPHS (polyhydroxy titanium stearate) and the like as titanium acylate; and Orgatics TC-401 (titanium tetra acetylacetonate), TC-200 (titanium octylene glycolate), TC-750 (titanium ethyl acetoacetate), TC-310 (titanium lactate), TC-400 (titanium triethanol aminate) and the like as titanium chelate (all products are manufactured by Matsumoto Fine Chemical Co., Ltd.).

The amount of the catalyst added is preferably from 0.01 to 0.50 mass parts per 100 mass parts of the saturated crystalline polyester resin (SC). The aforementioned catalysts may be used singly or a plurality of catalysts may be used. Furthermore, the catalyst may be added at the beginning of polymerization or in the middle of polymerization.

For the saturated crystalline polyester resin (SC) according to the present invention, the chloroform soluble content has a main peak in the molecular weight region of preferably equal to or more than $0.5\times10^4$ and equal to or less than $1.5\times10^4$, and more preferably equal to or more than $0.6\times10^4$ and equal to or less than $1.4\times10^4$ in the molecular weight distribution measured by gel permeation chromatography (GPC). Thus, storage stability, durability and resistance to contamination of the photo-sensitive material of the toner of the present invention are excellent. When the above peak molecular weight is lower than $0.5\times10^4$, the saturated crystalline polyester resin (SC) is easily plasticized with respect to the carboxyl group-containing vinyl resin (C), the glycidyl group-containing vinyl resin (E), or the non-crystalline polyester resin (SN) and as a result, storage stability is worsened in some cases. On the other hand, when the above peak molecular weight is higher than $1.5\times10^4$, dispersibility of the saturated crystalline polyester resin (SC) in the carboxyl group-containing vinyl resin (C) or the glycidyl group-containing vinyl resin (E) and a reaction product of the vinyl resins, and further the non-crystalline polyester resin (SN), is worsened, and the saturated crystalline polyester resin (SC) is dropped from the toner, so that storage stability is lowered in some cases.

The saturated crystalline polyester resin (SC) according to the present invention has an endothermic peak derived from a crystalline melting point at a temperature of preferably equal to or more than 75 degrees centigrade and equal to or less than 120 degrees centigrade, and more preferably equal to or more than 80 degrees centigrade and equal to or less than 115 degrees centigrade in the measurement by differential scanning calorimetry (DSC). Thus, there is obtained a toner excellent in a balance between low temperature fixing properties and storage stability. When the above melting point is lower than 75 degrees centigrade, the saturated crystalline polyester resin (SC) is melted at a lower temperature and the viscosity of the toner is lowered, so that low temperature fixing properties are enhanced, but an external additive tends to be embedded and as a result, storage stability is worsened in some cases. On the other hand, when the melting point exceeds 120 degrees centigrade, storage stability is improved, but the saturated crystalline polyester resin (SC) is not fully melted when the toner is fixed and the saturated crystalline polyester resin (SC) does not contribute to the effect of fixing properties in some cases.

The acid value of the saturated crystalline polyester resin (SC) in the present invention is preferably equal to or more than 25 mgKOH/g and equal to or less than 70 mgKOH/g, and more preferably equal to or more than 30 mgKOH/g and equal to or less than 65 mgKOH/g. Thus, storage stability of the toner of the present invention is improved. When the above acid value is lower than 25 mgKOH/g, hydrophilic properties of the saturated crystalline polyester resin (SC) are lowered and the affinity with the non-crystalline polyester resin (SN) is increased. As a result, crystallization of the saturated crystalline polyester resin (SC) tends to be inhibited and at the same time the non-crystalline polyester resin (SN) tends to be plasticized when the saturated crystalline polyester resin (SC) is mixed with the non-crystalline polyester resin (SN). Thus, storage stability is lowered in some cases. On the other hand, when the above acid value is higher than 70 mgKOH/g, the molecular weight of the saturated crystalline polyester resin (SC) is substantially too lowered, so that storage stability is worsened in some cases.

Meanwhile, the structure of the saturated crystalline polyester resin (SC) may be specified by dissolving the saturated crystalline polyester resin (SC) in a poor solvent such as xylene, carrying out thorough hydrolysis of the xylene insoluble component by extracting the saturated crystalline polyester resin (SC) in a good solvent such as chloroform, and then separating by distillation or LC, and analyzing by a combination of methods such as gas chromatography (GC) as well as IR (infrared absorption spectrometry), NMR (nuclear magnetic resonance spectrometry), LC (liquid chromatography), MS (mass spectrometry) or the like.

The ester group concentration of the saturated crystalline polyester resin (SC) according to the present invention is preferably equal to or more than 10.0 mmol/g and equal to or less than 13.5 mmol/g, and more preferably equal to or more than 10.3 mmol/g and equal to or less than 12.0 mmol/g. Thus, storage stability of the toner is improved. When the above ester group concentration is within the above range, the polarity of the saturated crystalline polyester resin (SC) is increased, so that the affinity of the saturated crystalline polyester resin (SC) with the vinyl resin (A) having low polarity is greatly lowered. Thus, in the present invention, when the magnitude of the polarity is high in the order of the vinyl resin (A), the non-crystalline polyester resin (SN) and the saturated crystalline polyester resin (SC), the saturated crystalline polyester resin (SC) is selectively incorporated into the island phase of the non-crystalline polyester resin (SN) that is dispersed in the vinyl resin (A). As a result, the probability of the saturated crystalline polyester resin (SC) to be exposed on the toner surface is reduced. Therefore, stickiness on the surface of the toner of the present invention is inhibited and storage stability is improved.

When the ester group concentration of the saturated crystalline polyester resin (SC) is lower than 10.0 mmol/g, the difference in the ester group concentrations of the non-crystalline polyester resin (SN) and the saturated crystalline polyester resin (SC) becomes smaller, thereby increasing the compatibility therebetween. Thus, crystallization of the saturated crystalline polyester resin (SC) tends to be inhibited, a crystal of the saturated crystalline polyester resin (SC) is hardly formed in the island phase of the non-crystalline polyester resin (SN) that is dispersed in the vinyl resin (A), and the island phase itself is plasticized by the saturated crystalline polyester resin (SC), so that storage stability tends to be worsened in some cases.

In the present invention, the ester group concentration refers to the amount (mmol) of ester groups contained in 1 g of the resin. In case of a polyester resin, the difference between the total weight of carboxyl groups of the raw material before polymerization and the total weight of carboxyl groups of the resin after polymerization is the amount of ester groups formed by polymerization. The ester group concentration is calculated from the amount of the raw material carboxylic acid component and the acid value after polymerization. Meanwhile, the amount of ester groups present in the resin is the same as the amount of water molecules to be dehydrated during polymerization. Accordingly, it may also be calculated by dividing the amount of dehydration during polymerization by the weight of the resin after polymerization. Also, as described above, the ester group concentration may also be calculated by extracting the saturated crystalline polyester resin (SC) from the binder resin for a toner or the toner, specifying the structure and proportion of the carboxylic acid component by the structural analysis of the saturated crystalline polyester resin (SC), and measuring the acid value of the saturated crystalline polyester resin (SC).

<Non-Crystalline Polyester Resin (SN)>

The non-crystalline polyester resin (SN) according to the present invention is obtained by the polycondensation reaction with at least one or more diols and at least one or more dicarboxylic acids as main components. This non-crystalline polyester resin (SN) preferably has at least an aromatic ring structure, and more preferably has a bisphenol A-derived skeleton.

When the non-crystalline polyester resin (SN) has an aromatic ring structure, it is not compatible with the vinyl resin (A), but the affinity with the styrene skeleton as a main component of the vinyl resin (A) is increased and dispersibility of the island phase of the non-crystalline polyester resin (SN) in the vinyl resin (A) becomes excellent. Furthermore, from the fact that the non-crystalline polyester resin (SN) has ester groups, the non-crystalline polyester resin (SN) has affinity with the saturated crystalline polyester resin (SC) as compared to the vinyl resin (A). Meanwhile, since the non-crystalline polyester resin (SN) has an aromatic ring structure, the compatibility of the saturated crystalline polyester resin (SC) with the non-crystalline polyester resin (SN) is inhibited, the saturated crystalline polyester resin (SC) is easily crystallized in the island phase of the non-crystalline polyester resin (SN), and thus storage stability tends to be improved.

Furthermore, when the non-crystalline polyester resin (SN) has a bisphenol A-derived skeleton as an aromatic ring structure, the ester group concentration of the non-crystalline polyester resin (SN) tends to be more lowered, so that the compatibility of the saturated crystalline polyester resin (SC) with the non-crystalline polyester resin (SN) tends to be inhibited, the saturated crystalline polyester resin (SC) tends to be more crystallized in the island phase of the non-crystalline polyester resin (SN), and thus storage stability tends to be improved.

The aromatic ring structure in the non-crystalline polyester resin (SN) is confirmed by analyzing substituents on benzene rings by NMR or IR.

Examples of the alcohol component which is used as a raw material of the non-crystalline polyester resin (SN) according to the present invention include ethylene glycol, 1,2-butanediol, 1,2-propylene glycol, 1,3-propanediol, 1,3-butanediol, 1,4-butanediol, 2,3-butanediol, diethylene glycol, triethylene glycol, dipropylene glycol, 1,5-pentanediol, 1,6-hexanediol, neopentyl glycol, 2-ethyl-1,3-hexanediol, hydrogenated bisphenol A, bisphenol A-ethylene oxide adduct, bisphenol A-propylene oxide adduct and the like. Among these, preferably used are bisphenol A-propylene oxide adduct, triethylene glycol, ethylene glycol and neopentyl glycol.

For the non-crystalline polyester resin (SN) according to the present invention, the amount of the bisphenol A derivative such as bisphenol A-ethylene oxide adduct, bisphenol A-propylene oxide adduct or the like is preferably equal to or more than 20 mole %, more preferably equal to or more than 40 mole %, and further preferably equal to or more than 60 mole %, based on 100 mole % of the total alcohol component. Thus, a toner excellent in storage stability is obtained.

Examples of the dicarboxylic acid which is used as a raw material of the non-crystalline polyester resin (SN) according to the present invention include aliphatic saturated dicarboxylic acids, aliphatic unsaturated dicarboxylic acids, aromatic dicarboxylic acids, anhydrides of the above various dicarboxylic acids or lower alkyl esters having 1 to 6 carbon atoms of the above various dicarboxylic acids. Examples of the aliphatic saturated dicarboxylic acids include malonic acid, succinic acid, glutaric acid, adipic acid, azelaic acid, sebacic acid and the like. Examples of the aliphatic unsaturated dicarboxylic acids include maleic acid, fumaric acid, citraconic acid, itaconic acid and the like. Examples of the aromatic dicarboxylic acids include phthalic acid, terephthalic acid, isophthalic acid and the like. Examples of the anhydrides of the above various dicarboxylic acids include succinic anhydride, maleic anhydride, phthalic anhydride and the like. Examples of the lower alkyl esters having 1 to 6 carbon atoms of the above various dicarboxylic acids include dimethyl succinate, diethyl maleate, dihexyl phthalate and the like. Among these, preferably used are terephthalic acid and isophthalic acid. Furthermore, for the purpose of adjusting the acid value, there may be used aliphatic monocarboxylic acids such as octanoic acid, decanoic acid, dodecanoic acid, myristic acid, palmitic acid, stearic acid and the like; or aromatic monocarboxylic acids such as benzoic acid, naphthalenecarboxylic acid and the like.

For the non-crystalline polyester resin (SN) according to the present invention, the amount of the aromatic dicarboxylic acid used is preferably equal to or more than 60 mole %, more preferably equal to or more than 75 mole %, and further preferably equal to or more than 85 mole %, based on 100 mole % of the total carboxylic acid component. Thus, a toner excellent in storage stability is obtained.

Meanwhile, as the raw material of the non-crystalline polyester resin (SN) according to the present invention, there may be used tri- or higher polycarboxylic acid such as trimellitic acid, pyromellitic acid and acid anhydrides thereof; or tri- or higher polyhydric alcohol such as trimethylolpropane, glycerin, 2-methylpropanetriol, trimethylolethane and the like. However, when the non-crystalline polyester resin (SN) has a crosslinked structure and contains the THF insoluble component, dispersibility of the non-crystalline polyester resin (SN) in the vinyl resin (A) tends to be lowered. For the non-crystalline polyester resin (SN), the amount of the tri- or higher polycarboxylic acid used is preferably equal to or less than 10 mole %, based on the total carboxylic acid component, while the amount of the tri- or higher polyhydric alcohol used is preferably equal to or less than 10 mole %, based on the total alcohol component, such that the THF insoluble component is not generated.

The temperature for carrying out the polycondensation reaction of the non-crystalline polyester resin (SN) is generally preferably from 170 to 270 degrees centigrade and more preferably from 180 to 250 degrees centigrade. When the reaction temperature is less than 170 degrees centigrade, the reaction time is increased so that the productivity is lowered in some cases. On the other hand, when the reaction temperature exceeds 270 degrees centigrade, decomposition of the resin is caused in some cases. As the catalyst for the polycondensation reaction, catalysts in use are the same as those used for the polycondensation reaction of the aforementioned saturated crystalline polyester resin (SC). The amount of the aforementioned catalyst added is preferably from 0.01 to 0.50 mass parts, based on 100 mass parts of the non-crystalline polyester resin (SN). The catalysts may be used singly or a plurality thereof may be used. Furthermore, the catalyst may be added at the beginning of polymerization or in the middle of polymerization.

For the non-crystalline polyester resin (SN) according to the present invention, it is preferable that the THF soluble content has a main peak in the molecular weight region of equal to or more than $0.3\times10^4$ and equal to or less than $1.0\times10^4$, and preferably equal to or more than $0.4\times10^4$ and equal to or less than $0.9\times10^4$ in the molecular weight distribution measured by gel permeation chromatography (GPC). Thus, a toner excellent in fixing properties and storage stability is obtained. When the above peak molecular weight is lower than $0.3\times10^4$, the compatibility with the vinyl resin (A) becomes excessively high, so that storage stability is worsened in some cases. On the other hand, when the above peak molecular weight is higher than $1.0\times10^4$, dispersibility in the vinyl resin (A) is lowered so that storage stability is reduced in some cases, and melt fluidity is also lowered so that fixing properties are worsened in some cases.

The non-crystalline polyester resin (SN) according to the present invention does not have an endothermic peak derived from a crystalline melting point in the measurement by differential scanning calorimetry (DSC). Furthermore, the glass transition temperature (Tg) of the non-crystalline polyester resin (SN) is preferably equal to or more than 55 degrees centigrade and equal to or less than 70 degrees centigrade in the measurement by DSC. Thus, a toner excellent in fixing properties and storage stability is obtained. When the above Tg is less than 55 degrees centigrade, storage stability is lowered in some cases. On the other hand, when the above Tg exceeds 70 degrees centigrade, fixing properties are lowered in some cases.

The acid value of the non-crystalline polyester resin (SN) according to the present invention is preferably equal to or more than 25 mgKOH/g and equal to or less than 70 mgKOH/ g, and more preferably equal to or more than 25 mgKOH/g and equal to or less than 40 mgKOH/g. Thus, a toner excellent in storage stability and durability is obtained. When the above acid value is lower than 25 mgKOH/g, in the dispersion step of the non-crystalline polyester resin (SN) during the reaction of the carboxyl group-containing vinyl resin (C) with the glycidyl group-containing vinyl resin (E), dispersibility of the non-crystalline polyester resin (SN) is worsened and as a result, the non-crystalline polyester resin (SN) is dropped and storage stability of the toner is worsened in some cases. On the other hand, when the above acid value is higher than 70 mgKOH/g, the molecular weight of the non-crystalline polyester resin (SN) is substantially too lowered, so that storage stability is worsened in some cases.

The ester group concentration of the non-crystalline polyester resin (SN) according to the present invention is preferably equal to or more than 3.0 mmol/g and equal to or less than 7.0 mmol/g, and more preferably equal to or more than 3.5 mmol/g and equal to or less than 5.5 mmol/g. Thus, a toner excellent in storage stability is obtained. When the above ester group concentration is too much lower than 3.0 mmol/g, hydrophobic properties of the non-crystalline polyester resin (SN) become too strong, the non-crystalline polyester resin (SN) is too dissolved to the vinyl resin (A), the saturated crystalline polyester resin (SC) is hardly incorporated into the island phase of the non-crystalline polyester resin (SN), and thus storage stability is lowered in some cases. On the other hand, when the above ester group concentration is too much higher than 7.0 mmol/g, the affinity with the vinyl resin (A) is lowered, dispersibility of the non-crystalline polyester resin (SN) is worsened, the saturated crystalline polyester resin (SC) tends to be dissolved in the non-crystalline polyester resin (SN), the non-crystalline polyester resin (SN) is plasticized, and thus storage stability is worsened in some cases.

<Metal Component (M)>

In the present invention, the metal component (M) selected from Zn (zinc), Ca (calcium), Mg (magnesium), Al (aluminum) and Ba (barium) (however, excluding metal oxide) is dispersed at least in the saturated crystalline polyester resin (SC). Since slip effect is not intended by the metal component (M), the metal component is not segregated on the surface layer of the toner, unlike as a metal contained in the external additive as a lubricant. As the metal component (M), preferably used are Zn and Ca.

The presence of the metal component (M) according to the present invention in the saturated crystalline polyester resin (SC) may be confirmed by the following method. That is, in case of the binder resin for a toner, it may be confirmed by carrying out trimming, surface shaping, and then scanning electron microscope (SEM)/X-ray microanalyzer (XMA) mapping analysis at a magnification of ×1,000 to ×5,000. Here, the observation area is about 114 μm×76 μm at a magnification of ×1,000 and about 25 μm×20 μm at a magnification of ×5,000. In case of the toner, it may be confirmed by first covering the toner with an epoxy resin or the like and then carrying out the same operation as in the binder resin. On the other hand, segregation of the metal contained in the external additive on the toner surface may be confirmed by carrying out scanning electron microscope (SEM)/X-ray microanalyzer (XMA) mapping analysis.

The metal component (M) according to the present invention does not contain metal oxide. That is, the metal component (M) does not contain a metal component contained in the magnetic material.

The metal component (M) according to the present invention and the magnetic material (metal oxide) are distinguished by dissolving a resin or a toner in THF and taking out the magnetic material using a magnet or the like. The metal component contained in the magnetic material taken out may be analyzed by a known method such as X-ray fluorescence (XRF) or the like.

The metal component (M) may be derived from an organic metal salt. More specifically, the metal component (M) may be selected from Zn, Ca, Mg, Al and Ba derived from a fatty acid metal salt represented by the following general formula. Preferably used are Zn and Ca.

$$(C_nH_{2n+1}COO)_m\text{-}M$$

wherein, in the above general formula, n is an integer of 11 to 22; m is an integer of 2 or 3; and M is a metal selected from Zn, Ca, Mg, Al and Ba.

The content of the metal component (M) is preferably equal to or more than 0.001 mass % and equal to or less than 0.120 mass %, more preferably equal to or more than 0.010 mass % and equal to or less than 0.110 mass %, and further preferably equal to or more than 0.015 mass % and equal to or less than 0.100 mass %, based on the total content of 100 mass % of the vinyl resin (A), the saturated crystalline polyester resin (SC) and the non-crystalline polyester resin (SN).

The weight of the metal component (M) in the binder resin for a toner or the toner of the present invention may be measured by a known analysis method such as X-ray fluorescence (XRF) or the like.

When the metal component (M) according to the present invention is contained, there can be obtained a toner excellent in offset resistance, storage stability, durability and resistance to contamination of the photo-sensitive material. Furthermore, since the fatty acid metal salt is not soluble in the saturated crystalline polyester resin (SC), the fatty acid metal salt is present in the saturated crystalline polyester resin (SC) as a domain and such a portion functions as a crystalline nucleating agent, thus accelerating crystallization. Therefore, the non-crystalline portion causing stickiness which is present in the saturated crystalline polyester resin (SC) is reduced, so that a toner excellent in storage stability is obtained.

Furthermore, the aforementioned fatty acid metal salt of the metal component (M) according to the present invention functions as a reaction catalyst of the carboxyl group and the glycidyl group in the reaction step of the carboxyl group-containing vinyl resin (C) with the glycidyl group-containing vinyl resin (E). When a mixture of the non-crystalline polyester resin (SN) and the saturated crystalline polyester resin (SC) contains a fatty acid metal salt, in the above reaction step, the reaction of the carboxyl group-containing vinyl resin (C) with the glycidyl group-containing vinyl resin (E) is accelerated in the vicinity of an interface of the island phase of the non-crystalline polyester resin (SN). Thus, kneading shear efficiently accelerates formation or dispersion of the island phase of the non-crystalline polyester resin (SN). Therefore, the island phase of the non-crystalline polyester resin (SN) is easily dispersed in the carboxyl group-containing vinyl resin (C), the glycidyl group-containing vinyl resin (E) and a reaction product thereof. As a result, since the non-crystalline polyester resin (SN) and the saturated crystalline polyester resin (SC) present in the island phase are hardly dropped from the toner, the toner having excellent durability is obtained, and formation of a crosslinked body of the carboxyl group-containing vinyl resin (C) and the glycidyl group-containing vinyl resin (E) tends to proceed, a toner exhibiting excellent offset resistance as well is obtained.

Examples of the fatty acid metal salt according to the present invention include Zn salt, Ca salt and the like of lauric acid, myristic acid, palmitic acid, stearic acid and behenic acid. Particularly preferably used are zinc stearate and calcium stearate.

As a method for feeding the aforementioned fatty acid metal salt, preferably used is a method in which a saturated crystalline polyester resin (SC) or a mixture of a saturated crystalline polyester resin (SC) and a non-crystalline polyester resin (SN) is heated at a temperature of equal to or more than the melting point of the saturated crystalline polyester resin (SC) and the melting point of the fatty acid metal salt and equal to or less than 170 degrees centigrade, and preferably equal to or less than 160 degrees centigrade, and then the fatty acid metal salt is added and dispersed with stirring, from the viewpoint of dispersibility of the fatty acid metal salt.

<Binder Resin for Toner>

The binder resin for a toner of the present invention contains the vinyl resin (A) composed of the aforementioned carboxyl group-containing vinyl resin (C), the glycidyl group-containing vinyl resin (E) and a reaction product of the vinyl resins, the non-crystalline polyester resin (SN), and the saturated crystalline polyester resin (SC) containing a metal component (M). By such a configuration, there can be obtained a toner excellent in a balance among low temperature fixing properties, offset resistance and storage stability.

The content of the vinyl resin (A) is preferably equal to or more than 65 mass % and equal to or less than 95 mass %, more preferably equal to or more than 70 mass % and equal to or less than 90 mass %, and further preferably equal to or more than 75 mass % and equal to or less than 90 mass %, based on the total content of 100 mass % of the vinyl resin (A), the non-crystalline polyester resin (SN) and the saturated crystalline polyester resin (SC). Thus, a toner excellent in a balance among low temperature fixing properties, offset resistance and storage stability is obtained. When the content of the vinyl resin (A) is lower than 65 mass %, low temperature fixing properties are improved, but the content of the crosslinking component of the vinyl resin (A) is lowered and thus offset resistance is worsened in some cases. On the other hand, in the case of the content of the vinyl resin (A) is too much lower than 65 mass %, when it is used for a toner, the island phase consisting of the non-crystalline polyester resin (SN) and the saturated crystalline polyester resin (SC) is not dispersed less than 2 μm, or the island phase is not formed and non-crystalline polyester resin (SN) and the saturated crystalline polyester resin (SC) form a continuous phase, the aforementioned polyester resin component is detached from the toner, and thus storage stability is remarkably lowered in some cases. On the other hand, when the content of the vinyl resin (A) is higher than 95 mass %, the saturated crystalline polyester resin (SC) does not have a sufficient influence on low temperature fixing properties in some cases.

Meanwhile, the total content of the non-crystalline polyester resin (SN) and the saturated crystalline polyester resin (SC) is preferably equal to or more than 5 mass % and equal to or less than 35 mass %, more preferably equal to or more than 10 mass % and equal to or less than 30 mass %, and further preferably equal to or more than 10 mass % and equal to or less than 25 mass %, based on the total content of 100 mass % of the vinyl resin (A), the non-crystalline polyester resin (SN) and the saturated crystalline polyester resin (SC). Thus, a toner excellent in a balance among low temperature fixing properties, offset resistance and storage stability is obtained.

For the binder resin for a toner of the present invention, the non-crystalline polyester resin (SN) is dispersed in an island form in the vinyl resin (A), the saturated crystalline polyester resin (SC) is present in the island phase of the non-crystalline polyester resin (SN), and the island phase has a crystal structure derived from the saturated crystalline polyester resin (SC). That is, the vinyl resin (A) forms a sea phase, so that the binder resin for a toner of the present invention has a sea-island structure in which the island phase of the non-crystalline polyester resin (SN) is dispersed in the sea phase. The saturated crystalline polyester resin (SC) is selectively distributed inside the island phase of the non-crystalline polyester resin (SN).

For the binder resin for a toner of the present invention, the phase of the saturated crystalline polyester resin (SC) is formed inside the phase of the non-crystalline polyester resin (SN).

Also, for the binder resin for a toner of the present invention, the saturated crystalline polyester resin (SC) is present inside the island phase of the non-crystalline polyester resin (SN) that is dispersed at least in the vinyl resin (A), and at the same time the saturated crystalline polyester resin (SC) may be, even in a small amount, present in the vinyl resin (A) outside such an island phase. However, it is preferable that the saturated crystalline polyester resin (SC) is substantially present only inside the island phase of the non-crystalline polyester resin (SN).

The saturated crystalline polyester resin (SC) is present only inside the island phase of the non-crystalline polyester resin (SN) depending on the content ratio of the saturated crystalline polyester resin (SC) and the non-crystalline polyester resin (SN). When the content ratio of the non-crystalline polyester resin (SN) is low, the saturated crystalline polyester resin (SC) is also present in the vinyl resin (A) outside the island phase of the non-crystalline polyester resin (SN).

The island phases of the non-crystalline polyester resin (SN) may be contacted to each other if island phases are respectively maintained (if a continuous phase is not formed).

Hereinafter, the mechanism of the binder resin for a toner of the present invention having a structure in which the saturated crystalline polyester resin (SC) is present inside the island phase of the non-crystalline polyester resin (SN) will be considered.

First, in the present invention, since the saturated crystalline polyester resin (SC) contains lots of ester groups, hydrophilic properties are extremely high as compared to the non-crystalline polyester resin (SN) or the vinyl resin (A). On the other hand, since the vinyl resin (A) has styrene as a main component, hydrophilic properties are low. Accordingly, the affinity of the saturated crystalline polyester resin (SC) with the vinyl resin (A) is extremely low and the saturated crystalline polyester resin (SC) has no solubility. In the present invention, since the non-crystalline polyester resin (SN) has an aromatic ring structure, the affinity with the vinyl resin (A) is higher than the saturated crystalline polyester resin (SC). Furthermore, similarly to the saturated crystalline polyester resin (SC), the non-crystalline polyester resin (SN) is a polyester resin, so that the affinity with the saturated crystalline polyester resin (SC) is higher than the vinyl resin (A). Accordingly, when the non-crystalline polyester resin (SN) and the saturated crystalline polyester resin (SC) are dispersed in the vinyl resin (A), the saturated crystalline polyester resin (SC) is incorporated into the island phase of the non-crystalline polyester resin (SN). Furthermore, in the present invention, by controlling a chemical structure of the ester group concentration of the saturated crystalline polyester resin (SC) and adding the metal component (M) of a fatty acid metal salt or the like, crystallization of the saturated crystalline polyester resin (SC) in the island phase is accelerated, and a crystal structure derived from the saturated crystalline polyester resin (SC) is formed in the island phase.

With the formation of such a structure inside the binder resin, stickiness of the toner due to the saturated crystalline polyester resin (SC) is suppressed by the non-crystalline polyester resin (SN), so that a toner excellent in a balance between low temperature fixing properties and storage stability is obtained. When the metal component (M) of a fatty acid metal salt or the like is not present, the saturated crystalline polyester resin (SC) is not crystallized and stickiness of the toner is caused by the entire island phase, so that storage stability is worsened.

The aforementioned structure may be confirmed by observing at a magnification of ×10,000 to ×60,000 using a transmission electron microscope (TEM). Here, the observation area is about 25.5 μm×16 μm at a magnification of ×10,000 and about 4.25 μm×2.67 μm at a magnification of ×60,000. When a measurement sample is a binder resin, the binder resin is trimmed, surface shaping, and then dyed with $RuO_4$, whereby an ultra thin film piece is prepared and observed. When a measurement sample is a toner, the toner is wrapped with an epoxy resin and is observed in the same manner as in the resin. Since a striped pattern derived from the crystal structure is densely dyed and the non-crystalline portion is lightly dyed, the presence of the crystal structure inside the island phase may be confirmed. Furthermore, by observation according to the above method, an area of the island phase of the saturated crystalline polyester resin (SC) in the non-crystalline polyester resin (SN) and the vinyl resin (A) may be confirmed and the proportion of the vinyl resin (A) may also be confirmed from the area ratio.

The glass transition temperature (Tg) of the binder resin for a toner of the present invention measured by DSC is preferably equal to or more than 50 degrees centigrade and equal to or less than 65 degrees centigrade, and more preferably equal to or more than 53 degrees centigrade and equal to or less than 62 degrees centigrade. Thus, a toner excellent in low temperature fixing properties and storage stability is obtained. When the above Tg is lower than 50 degrees centigrade, storage stability of the toner is worsened in some cases. On the other hand, when the above Tg is higher than 65 degrees centigrade, low temperature fixing properties are worsened in some cases.

For the binder resin for a toner of the present invention, the tetrahydrofuran (THF) soluble content has a main peak in the molecular weight region of preferably equal to or more than $0.3\times10^4$ and less than $2.0\times10^4$, and more preferably equal to or more than $0.4\times10^4$ and less than $1.8\times10^4$ in the molecular weight distribution measured by gel permeation chromatography (GPC). Thus, a toner excellent in low temperature fixing properties is obtained. When the above peak molecular weight is lower than $0.3\times10^4$, storage stability and durability of the toner are easily adversely affected in some cases. On the other hand, when the above peak molecular weight is higher than $2.0\times10^4$, fixing performance is worsened in some cases.

For the binder resin for a toner of the present invention, the content of the tetrahydrofuran (THF) insoluble content is preferably equal to or more than 5 mass % and less than 40 mass %, and more preferably equal to or more than 10 mass % and less than 35 mass %. In the present invention, the tetrahydrofuran (THF) insoluble content contains at least a crosslinked body formed by the reaction of the carboxyl group-containing vinyl resin (C) with the glycidyl group-containing vinyl resin (E). For the binder resin for a toner of the present invention, when the tetrahydrofuran (THF) insoluble content is smaller than the above range, elasticity is not sufficient and offset resistance is worsened in some cases when it is used for a toner. When the content is greater than the above range, the crosslinking component is excessively shrunk; therefore, the crosslinking component is excessively phase-separated from the non-crosslinking component without letting the low molecular weight component get into a network structure of the crosslinked body; and finally, there is no effect of the crosslinking component on offset resistance in some cases.

The ratio of the carboxyl group-containing vinyl resin (C) to the glycidyl group-containing vinyl resin (E) (C/E) is preferably from 87/13 to 99/1 and more preferably from 89/11 to 97/3 in terms of the mass ratio. Thus, a toner excellent in offset resistance is obtained. When the content of the aforementioned glycidyl group-containing vinyl resin (E) exceeds 13 mass %, based on the total content of 100 mass % of the carboxyl group-containing vinyl resin (C) and the glycidyl group-containing vinyl resin (E), offset resistance is lowered in some cases. It is considered that this is caused by the fact that, in the reaction of the carboxyl group with the glycidyl group, the molecular weight among the crosslinked points of the crosslinked body becomes small and the crosslinking component is excessively shrunk as the reaction proceeds; therefore, the crosslinking component is excessively phase-separated from the non-crosslinking component without letting the low molecular weight component get into a network structure of the crosslinked body; and finally, there is no effect of the crosslinking component on offset resistance. On the other hand, when the content of the aforementioned glycidyl group-containing vinyl resin (E) is smaller than 1 mass %, the crosslinking component is not sufficiently generated by the reaction of the carboxyl group-containing vinyl resin with the glycidyl group-containing vinyl resin, and offset resistance is worsened in some cases.

Next, the effect of the present invention is further described as compared to the art described in the aforementioned Patent Documents.

In the technical field of the toner, there is a tradeoff relationship between low temperature fixing properties and storage stability.

The art described in the aforementioned documents was an art for properly adjusting the degree of low temperature fixing properties and storage stability by controlling the amount of the crystalline polyester without improving this tradeoff relationship. That is, when the amount of the crystalline polyester was high, low temperature fixing properties of the toner were improved, but the crystalline polyester was easily detached from the toner so that storage stability of the toner was lowered in some cases. On the other hand, when the amount of the crystalline polyester was small, storage stability was improved, but low temperature fixing properties were lowered.

Meanwhile, in the present invention, there is adopted a structure in which the island phase of the non-crystalline polyester resin (SN) is dispersed in the sea phase of the vinyl resin (A), and the saturated crystalline polyester resin (SC) is included in this island phase. Thus, the effect of low temperature fixing properties of the saturated crystalline polyester resin (SC) is achieved, detachment of the saturated crystalline polyester resin (SC) is suppressed, and the probability of the presence of the saturated crystalline polyester resin (SC) on the toner surface is reduced, whereby deterioration of storage stability of the toner is prevented. Therefore, in the present invention, a tradeoff relationship between low temperature fixing properties and storage stability is improved.

Hereinafter, the method for producing a binder resin for a toner of the present invention will be described.

The method for producing a binder resin for a toner of the present invention includes obtaining a mixture of the aforementioned non-crystalline polyester resin (SN), the saturated crystalline polyester resin (SC) and the metal component (M), and mixing the obtained mixture, the carboxyl group-containing vinyl resin (C) and the glycidyl group-containing vinyl resin (E) in the melt state.

In the method for producing a binder resin for a toner of the present invention, it is preferable that the non-crystalline polyester resin (SN) and the saturated crystalline polyester resin (SC) and the metal component (M) are previously mixed in the melt state and the mixture is added in the reaction of the carboxyl group-containing vinyl resin (C) with the glycidyl group-containing vinyl resin (E) to be described later, such that the saturated crystalline polyester resin (SC) is efficiently incorporated into the island phase of the non-crystalline polyester resin (SN) in the binder resin.

In the method for producing a binder resin for a toner of the present invention, the content of the non-crystalline polyester resin (SN) is preferably equal to or more than 15 mass % and equal to or less than 70 mass %, and more preferably equal to or more than 20 mass % and equal to or less than 65 mass %, based on the total content of 100 mass % of the non-crystalline polyester resin (SN) and the saturated crystalline polyester resin (SC). Thus, a toner excellent in storage stability and durability is obtained. Furthermore, when the content of the saturated crystalline polyester resin (SC) is within the above range, the saturated crystalline polyester resin (SC) is incorporated into the island phase of the non-crystalline polyester resin (SN), the probability of the presence of the saturated crystalline polyester resin (SC) on the toner surface is reduced when it is used for a toner, and stickiness of the toner is suppressed, so that a toner excellent in storage stability is obtained. When the content of the non-crystalline polyester resin (SN) is lower than 15 mass %, the saturated crystalline polyester resin (SC) tends to be present in large quantities at an interface between the island phase of the non-crystalline polyester resin (SN) and the vinyl resin (A), the probability of exposure of the saturated crystalline polyester resin (SC) on the toner surface is increased when it is used for a toner, and thus storage stability is worsened in some cases. In this case, the affinity between the island phase and the vinyl resin (A) is reduced, the saturated crystalline polyester resin (SC) is dropped from the toner, and thus durability and storage stability are reduced in some cases. On the other hand, when the content of the non-crystalline polyester resin (SN) is higher than 70 mass %, most of the saturated crystalline polyester resin (SC) is dissolved in the non-crystalline polyester resin (SN), the saturated crystalline polyester resin (SC) is hardly crystallized in the island phase, and thus storage stability is lowered in some cases.

As a method for reacting the carboxyl group-containing vinyl resin (C) with the glycidyl group-containing vinyl resin (E), preferably used is a method involving mixing and reacting the carboxyl group-containing vinyl resin (C) with the glycidyl group-containing vinyl resin (E) in the melt state in the presence of the saturated crystalline polyester resin (SC) containing at least the metal component (M) of a fatty acid metal salt or the like. Thus, a toner excellent in offset resistance, storage stability and durability is obtained. As such a method, any conventionally known methods may be used. For example, there may be adopted a method involving introducing both resins into a reaction container equipped with a stirrer and heating the resulting material for the reaction in the melt state, or a method involving reacting both resins in the presence of a solvent and removing the solvent. In particular, preferably used is a method involving employing a twin screw kneader. Concrete examples thereof include a method involving mixing powders of the carboxyl group-containing vinyl resin (C) and the glycidyl group-containing vinyl resin (E) and the saturated crystalline polyester resin (SC) containing at least the metal component (M) of a fatty acid metal salt or the like by the use of a Henschel mixer or the like, and then conducting melt-kneading and reaction using a twin screw kneader, and a method involving feeding the carboxyl group-containing vinyl resin (C) and the glycidyl group-containing vinyl resin (E) and the saturated crystalline polyester resin (SC) containing at least the metal component (M) of a fatty acid metal salt or the like in the melt state to a twin screw kneader for conducting melt-kneading and reaction.

The temperature for conducting melt-kneading and reaction is different depending on the contents of functional groups and the molecular weights of the carboxyl group-containing vinyl resin (C) and the glycidyl group-containing vinyl resin (E), but it is preferably in the range of 100 to 220 degrees centigrade, more preferably in the range of 120 to 200 degrees centigrade, and further preferably in the range of 130 to 180 degrees centigrade. When the reaction temperature is lower than 100 degrees centigrade, even though formation of a crosslinked body occurs, kneading shear is extremely strong, and the formed crosslinked body is cut, so that offset resistance is worsened in some cases. When it exceeds 220 degrees centigrade, a crosslinking reaction excessively proceeds and the crosslinking component is phase-separated from the non-crosslinking component, so that there is no effect on offset resistance in some cases, or depolymerization occurs and the volatile component remained in the binder resin for a toner is increased, so that there are problems in the feature of maintaining development quality of the toner, odor and the like in some cases.

As a method for melt-kneading and reacting using a twin screw kneader, water is injected into the twin screw kneader in an amount of preferably equal to or more than 0.5 mass parts and equal to or less than 2.5 mass parts, and more preferably equal to or more than 1.0 mass part and equal to or less than 2.0 mass parts, based on 100 mass parts of the resin at a pressure of preferably equal to or more than 1 MPa and equal to or less than 3 MPa, and more preferably equal to or more than 1.7 MPa and equal to or less than 2.3 MPa. Then, water and the volatile component are preferably removed by reducing the pressure preferably at 0.001 to 0.200 MPa and more preferably at 0.050 to 0.150 MPa from a pressure reducing port placed at an outlet side from a pressure inlet. Incidentally, in the present invention, the pressure refers to a gauge pressure, that is, a value subtracting an atmospheric pressure from an absolute pressure based on a vacuum otherwise particularly specified. By having the injection pressure within the above range, water is fully mixed in the resin so that the volatile component such as a monomer, a solvent or the like remained in the resin during reduction of pressure is easily removed. Furthermore, when the amount of water injected is excessively small, the volatile component may not be fully removed in some cases. On the other hand, when the amount of water injected is excessively high, the state of water dispersed in the resin is worsened and as a result, the volatile component is hardly removed in some cases. Furthermore, by having the reduced pressure within the above range, the volatile component may be fully removed from the resin. Besides, with the use of such a method, the volatile content remained in the binder resin may be equal to or less than 200 ppm and the oligomer component having a molecular weight of equal to or less than 1,000 may be reduced at the same time; therefore, such a method is preferable.

The thus-obtained resin is cooled and ground to give a binder resin for a toner. As a method for cooling and grinding, any of conventionally known methods may be adopted, and as a method for cooling, a steel belt cooler or the like can also be used for rapid cooling.

<Toner>

Hereinafter, the toner of the present invention will be described.

The toner of the present invention contains the aforementioned binder resin for a toner, a coloring agent and a releasing agent.

For the toner of the present invention, the dispersion diameter of the island phase of the non-crystalline polyester resin (SN) is preferably equal to or less than 2.0 μm, and more preferably equal to or less than 1.0 μm. When the dispersion diameter of the aforementioned island phase is greater than 2.0 μm, the island phase tends to be detached from the toner when the toner is stirred and as a result, storage stability is worsened in some cases.

The toner of the present invention contains at least one or more releasing agents having a melting point at equal to or more than −40 degrees centigrade and equal to or less than 5 degree centigrade, and further preferably equal to or more than −35 degrees centigrade and equal to or less than 0 degree centigrade, based on the melting point of the saturated crystalline polyester resin (SC). The releasing agent is contained in an amount of equal to or more than 1 mass % and equal to or less than 10 mass %, and further preferably equal to or more than 2 mass % and equal to or less than 8 mass %. When at least one or more releasing agents having a melting point within the above range is contained, attachment of the saturated crystalline polyester resin (SC) onto the fixing roll is prevented and thus offset resistance is improved.

For the toner of the present invention, the tetrahydrofuran (THF) soluble content has a main peak in the molecular weight region of preferably equal to or more than $0.3\times10^4$ and less than $2.0\times10^4$, and more preferably equal to or more than $0.4\times10^4$ and less than $1.8\times10^4$ in the molecular weight distribution measured by gel permeation chromatography (GPC). Thus, a toner excellent in low temperature fixing properties is obtained. When the above peak molecular weight is lower than $0.3\times10^4$, storage stability and durability of the toner are easily adversely affected in some cases. When the above peak molecular weight is higher than $2.0\times10^4$, fixing performance is worsened in some cases.

For the toner of the present invention, the THF insoluble content derived from the binder resin is preferably equal to or more than 5 mass % and less than 40 mass %, and further preferably equal to or more than 10 mass % and less than 35 mass %. Thus, a toner excellent in offset resistance is obtained. When the content of the aforementioned THF insoluble content is adjusted to be within the above range, offset resistance is improved without damaging excellent low temperature fixing properties.

The glass transition temperature (Tg) of the toner of the present invention measured by DSC is preferably equal to or more than 50 degrees centigrade and equal to or loss than 65 degrees centigrade, and more preferably equal to or more than 52 degrees centigrade and equal to or less than 60 degrees centigrade. Thus, a toner excellent in low temperature fixing properties and storage stability is obtained. When the above Tg is lower than 50 degrees centigrade, storage stability of the toner is worsened in some cases. When the above Tg is higher than 65 degrees centigrade, low temperature fixing properties are worsened in some cases.

Hereinafter, the method for producing a toner of the present invention will be described.

The method for producing a toner of the present invention involves obtaining the aforementioned binder resin for a toner, and mixing the binder resin for a toner and a coloring agent.

The toner of the present invention is produced according to a conventionally known method using the binder resin for a toner of the present invention. For example, the binder resin and additives such as a coloring agent, a releasing agent, a charge controlling agent and the like are sufficiently mixed using a powder mixer such as a Henschel mixer or the like, and then the resulting mixture is melt-kneaded using a kneading machine such as a twin screw kneader, an open roll kneader or the like for sufficiently mixing individual constituent components. The melt-kneaded material is cooled, pulverized and sieved to collect particles having a particle diameter of ordinarily 4 to 15 μm. A surface treatment agent is applied to the collected particles according to the powder mixing method, to obtain a toner. As necessary, the toner may be subjected to spheroidizing treatment using a surface treatment device or the like. Examples of the surface treatment method include a method of subjecting the toner to spheroidizing by inflowing it in a hot air jet and a method of taking an angle of the toner by mechanical impact. For the purpose of improvement of image quality or the like, an average circularity measured using a flow particle image analyzer (for example, FIPA-3000, manufactured by Sysmex Corporation) may be adjusted to be equal to or more than 0.960 by carrying out such surface treatment.

Hereinafter, respective components of the toner will be described.

<Releasing Agent>

It is preferable that the toner of the present invention contains at least one or more conventionally known releasing agents having a melting point preferably at equal to or more than −40 degrees centigrade and equal to or less than 5 degrees centigrade, based on the melting point of the saturated crystalline polyester resin (SC), and satisfying the condition of the melting point of equal to or more than 60 degrees centigrade and equal to or less than 120 degrees centigrade as a releasing agent.

Examples of the conventionally known releasing agents include aliphatic hydrocarbon wax such as low molecular weight polyethylene, low molecular weight polypropylene, polyolefin copolymer, polyolefin wax, paraffin wax, microcrystalline wax, Fisher-Tropsch wax and the like; oxide of aliphatic hydrocarbon wax such as oxidized polyethylene wax; vegetable wax such as candelilla wax, carnauba wax, Japan wax, rice wax and jojoba wax; animal wax such as bee wax, lanoline and whale wax; mineral wax such as ozokerite, ceresine and petrolatum; wax principally constituted of aliphatic ester such as montan ester wax and castor wax; and totally or partially deacidified aliphatic ester such as deacidified carnauba wax. Further examples include saturated linear aliphatic acid such as palmitic acid, stearic acid, montanic acid and long-chain alkyl carboxylic acid having a long-chain alkyl group; unsaturated aliphatic acid such as brassidic acid, eleostearic acid and parinaric acid; saturated alcohol such as stearyl alcohol, eicosyl alcohol, behenyl alcohol, carnaubyl alcohol, ceryl alcohol, melissyl alcohol and long-chain alkyl alcohol having a long-chain alkyl group; polyhydric alcohol such as sorbitol; aliphatic acid amide such as linoleic amide, oleyic amide and lauric amide; saturated aliphatic acid bisamides such as methylene bisstearamide, ethylene biscapamide, ethylene bislauramide and hexamethylene bisstearamide; unsaturated aliphatic acid amides such as ethylene bisoleamide, hexamethylene bisoleamide, N,N'-dioleyladipamide and N,N'-dioleylsebacamide; aromatic based bisamides such as m-xylenebisstearamide and N,N'-distearylisophthalamide; wax formed by grafting vinyl monomers such as styrene based monomers, acrylic based monomers, carboxyl group-containing monomers and glycidyl group-containing monomers to aliphatic hydrocarbon wax; partially esterified compounds of fatty acids and polyhydric alcohol such as behenic acid monoglyceride; and a methyl ester compound having a hydroxyl group obtained by hydrogenating vegetable oils or fats. Further, examples include wax having functional groups such as a hydroxyl groups, ester groups, carboxyl groups obtained by liquid-phase oxidation of higher aliphatic hydrocarbon having one or more double bonds obtained by an ethylene polymerization method or an olefination method by pyrolysis of petroleum hydrocarbons or an n-paraffin mixture obtained from petroleum fraction or polyethylene wax obtained by an ethylene polymerization method or higher aliphatic hydrocarbon obtained by a Fisher-Tropsch synthesis method with a molecular oxygen-containing gas in the presence of boric acid and boric anhydride; wax synthesized by a metallocene catalyst such as polyethylene, polypropylene, polybutene, polypentene, polyhexene, polyheptene, polyoctene, ethylene-propylene copolymer, ethylene-butene copolymer and butene-propylene copolymer; and ester group-containing wax obtained by the reaction of a halide of long-chain alkylcarboxylic acid with polyhydric alcohol or condensation with long-chain alkyl carboxylic acid with polyhydric alcohol. These releasing agents may be used singly or in combination of two or more kinds. When two or more kinds are used in combination, at least one or more releasing agents may have a melting point of equal to or more than −40 degrees centigrade and equal to or less than 5 degrees centigrade, based on the melting point of the saturated crystalline polyester resin (SC).

For the toner of the present invention, there is used at least one or more releasing agents having a melting point of preferably equal to or more than −40 degrees centigrade and equal to or less than 5 degrees centigrade, and further preferably equal to or more than −35 degrees centigrade and equal to or less than 0 degree centigrade, based on the melting point of the saturated crystalline polyester resin (SC). When the melting point of the releasing agent is within the above range, a toner excellent in fixing properties and offset resistance is obtained.

The saturated crystalline polyester resin (SC) according to the present invention is mainly composed of an alcohol component selected from aliphatic diols having 2 to 4 carbon atoms and a carboxylic acid component selected from aliphatic dicarboxylic acids having 4 to 6 carbon atoms, and rarely contains long-chain alkyl units, so that the saturated crystalline polyester resin (SC) itself does not have mold releasability. Accordingly, when the melting points of all releasing agents to be contained are higher than the melting point of the saturated crystalline polyester resin (SC), and when the toner is fixed on paper, the saturated crystalline polyester resin (SC) is rather melted earlier than the releasing agent and attached to the fixing roll, thus causing offset in some cases. So, the melting point of the releasing agent is preferably in the above range.

In order to improve the dispersion state in the toner, it is preferable that these releasing agents are added in the step of producing of the high molecular weight vinyl resin (H), the low molecular weight vinyl resin (L), the carboxyl group-containing vinyl resin (C), the glycidyl group-containing vinyl resin (E), the non-crystalline polyester resin (SN) and the saturated crystalline polyester resin (SC), in the step of mixing the non-crystalline polyester resin (SN), the saturated crystalline polyester resin (SC) and the metal component (M), or in the step of reacting the carboxyl group-containing vinyl resin (C) with the glycidyl group-containing vinyl resin (E) to be described below, or are separately added in respective steps. Further preferably, the devolatilization method that the releasing agent is added in the presence of a solvent and a block copolymer consisting of a block consisting of a sequence of the ethylenically hydrocarbon-derived constituent units and/or the conjugated diene hydrocarbon-derived constituent units and a block consisting of a sequence of the styrene-derived constituent units, and/or the hydrogenated block copolymer, i.e., the hydrogenated product of the block copolymer, in the step of producing the carboxyl group-containing vinyl resin (C). However, the method is not restricted to any of these addition methods. The releasing agent may be added according to the aforementioned method or a combination thereof, and further as necessary, it may also be added at the time of producing a toner.

In the present invention, the amount of the releasing agent added is preferably equal to or more than 1 mass % and equal to or less than 10 mass %, and further preferably equal to or more than 2 mass % and equal to or less than 8 mass %, based on the total amount of 100 mass % of the carboxyl group-containing vinyl resin (C), the glycidyl group-containing vinyl resin (E), a reaction product of the vinyl resins, the non-crystalline polyester resin (SN) and the saturated crystalline polyester resin (SC). Thus, a toner excellent in a balance between offset resistance and storage stability is obtained. When the amount of the releasing agent added is smaller than 1 mass %, there is no effect on the inhibition of offset of the saturated crystalline polyester resin (SC) in some cases. When it exceeds 10 mass %, deterioration of storage stability or deterioration of resistance to contamination of the photo-sensitive material and further deterioration of durability of the toner may be caused in some cases. It is considered that deterioration of storage stability is caused by the fact that the binder resin is easily plasticized by the releasing agent and the external additive is buried on the toner surface, while deterioration of resistance to contamination of the photo-sensitive material is caused by the fact that the toner is melted by frictional heat between the photo-sensitive material and a cleaning blade. Further, the releasing agent is worsened in dispersibility and dropped from the toner, thus reducing durability of the toner.

<Charge Controlling Agent>

It is preferable that the toner of the present invention contains a charge controlling agent in order to keep a positive electrostatic-charging property or a negative electrostatic-charging property. As the charge controlling agent, conventionally known charge controlling agents may be used.

Examples of the positive charge controlling agent include nigrosins and modified products of nigrosins with aliphatic metal salts; quaternary ammonium salts such as tributylbenzylammonium-1-hydroxy-4-naphtosulfonate salt and tetrabutylammonium tetrafluoro borate, and onium salts such as their phosphonium salts that are analogs of those compounds and the lake pigments thereof; triphenylmethane dyes and lake pigments thereof (laking agents: phosphorus tungstic acid, phosphorus molybdic acid, phosphorus tungsten molybdic acid, tannic acid, lauric acid, gallic acid, ferricyanide, ferrocyanide and the like); metal salts of higher fatty acids; diorganotin oxides such as dibutyltin oxide, dioctyltin oxide and dicyclohexyltin oxide; diorganotin borates such as dibutyltin borate, dioctyltin borate and dicyclohexyltin borate; guanidine compounds; imidazole compounds; and imidazolium salts. Further examples include quaternary ammonium salt group-containing copolymers obtained by a means of quaternization or the like with para-toluenesulfonic acid alkyl ester after copolymerizing dialkylaminoalkyl (meth)acrylate and a styrene based monomer and as necessary an acrylic based monomer.

As the negative charge controlling agent, for example, an organic metal complex and a chelate compound are effective, and examples thereof include a mono-azo metal complex, an acetylacetone metal complex, an aromatic hydroxycarboxylic acid metal complex, an aromatic dicarboxylic acid metal complex; aromatic hydroxycarboxylic acid, aromatic monocarboxylic acid or aromatic polycarboxylic acid and metal salts, anhydride, esters thereof, and a bisphenol derivative such as bisphenol. Further examples include an azo type metal compound having a coordination center metal selected from Sc, Ti, V, Cr, Co, Ni, Mn and Fe, and cation selected from hydrogen ion, sodium ion, potassium ion and ammonium ion; an aromatic hydroxycarboxylic acid derivative having a coordination center metal selected from Cr, Co, Ni, Mn, Fe, Ti, Zr, Zn, Si, B and Al, and cation selected from hydrogen ion, sodium ion, potassium ion, ammonium ion and aliphatic ammonium; a metal compound of an aromatic polycarboxylic acid derivative (the aromatic hydroxycarboxylic acid derivative and aromatic polycarboxylic acid may have an alkyl group, an aryl group, a cycloalkyl group, an alkenyl group, an alkoxy group, an aryloxy group, a hydroxyl group, an alkoxycarbonyl group, an aryloxycarbonyl group, an acyl group, an acyloxy group, a carboxyl group, halogen, a nitro group, a cyano group, an amide group, an amino group or a carbamoyl group as a substituent); and a polymer having a sulfonic acid group-containing monomer such as a copolymer of a sulfonic acid group-containing acrylamide based monomer, a styrene based monomer and an acrylic based monomer as a constituent component. These charge controlling agents may be used singly or in combination of two or more kinds.

The amount of the charge controlling agent added to the toner is preferably from 0.05 to 10 mass %, more preferably from 0.1 to 5 mass % and further preferably from 0.2 to 3 mass %, based on 100 mass % of the binder resin, from the viewpoint of a balance between the charge amount and fluidity of the toner. Furthermore, as a method of adding the charge controlling agent, a method of adding it into the inside of the toner, a method of externally adding, or a combination thereof may be applied. Incidentally, arbitrary metal oxide other than the metal component (M) may be contained in the binder resin for a toner of the present invention.

<Coloring Agent>

The color toner of the present invention contains a coloring agent. As the coloring agent, conventionally known pigments and dyes may be used.

Examples of the pigment include mineral fast yellow, navel yellow, Naphthol Yellow S, Hanza Yellow G, Permanent Yellow NCG, Tartrazine Lake, molybdenum orange, Permanent Orange GTR, Pyrazolone Orange, Benzidine Orange G, Permanent Red 4R, Watchung Red calcium salt, eosine lake, Brilliant Carmine 3B, manganese violet, Fast Violet B, Methyl Violet Lake, cobalt blue, Alkali Blue Lake, Victoria Blue Lake, Phthalocyanine Blue, Fast Sky Blue, Indanthrene Blue BC, chrome green, Pigment Green B, Malachite Green Lake, Final Yellow Green G and the like. Examples of the magenta coloring pigment include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, 238; C.I. Pigment Violet 19; C.I. Violet 1, 2, 10, 13, 15, 23, 29, 35 and the like. Examples of the cyan coloring pigment include C.I. Pigment Blue 2, 3, 15, 15:1, 15:2, 15:3, 16, 17; C.I. Acid Blue 6; C.I. Acid Blue 45; copper phthalocyanine pigments whose phthalocyanine skeleton has been substituted with 1 to 5 phthalimidomethyl group(s) and the like. Examples of the yellow coloring pigment include C.I. Pigment Yellow 1, 2, 3, 4, 5, 6, 7, 10, 11, 12, 13, 14, 15, 16, 17, 23, 65, 73, 74, 83, 93, 97, 155, 180, 185; C.I. Vat Yellow 1, 3, 20 and the like. Examples of the black pigment include carbon black such as furnace black, channel black, acetylene black, thermal black, lamp black and the like. Examples of the dye include C.I. Direct Red 1; C.I. Direct Red 4; C.I. Acid Red 1; C.I. Basic Red 1; C.I. Mordant Red 30; C.I. Direct Blue 1; C.I. Direct Blue 2; C.I. Acid Blue 9; C.I. Acid Blue 15; C.I. Basic Blue 3; C.I. Basic Blue 5; C.I. Mordant Blue 7; C.I. Direct Green 6; C.I. Basic Green 4; C.I. Basic Green 6; Solvent Yellow 162 and the like. These coloring agents may be used singly or in combination of two or more kinds.

The amount of the coloring agent added to the toner is preferably from 0.05 to 20 mass %, more preferably from 0.1 to 15 mass % and further preferably from 0.2 to 10 mass %, based on 100 mass % of the binder resin.

Meanwhile, a magnetic material may be used instead of these coloring agents. Examples of the magnetic material include metal oxides containing elements such as iron, cobalt, nickel, copper, magnesium, manganese, aluminum, silicon and the like. Concrete examples thereof include triiron tetraoxide, diiron trioxide, zinc iron oxide, yttrium iron oxide, cadmium iron oxide, gadolinium iron oxide, copper iron oxide, lead iron oxide, nickel iron oxide, neodymium iron oxide, barium iron oxide, magnesium iron oxide, manganese iron oxide, lanthanum iron oxide, iron powder, cobalt powder, nickel powder and the like. These magnetic materials may be used in combination of two or more kinds as necessary. Furthermore, as its shape, a magnetic material in spherical shape, octahedron or hexahedron is preferably used. In addition, a spherical magnetic material is preferably used because magnetic powder is uniformly dispersed in the toner.

A BET specific surface area of the magnetic powder according to a nitrogen adsorption method is preferably from 1 to 30 $m^2/g$ and further preferably from 2 to 20 $m^2/g$. Furthermore, it is preferable to use magnetic powder having a Mohs hardness of 4 to 8. The average particle diameter of the magnetic material is preferably from 0.01 to 0.8 μm and further preferably from 0.05 to 0.5 μm. As magnetic properties of the magnetic material, it is preferable that the coercivity is from 1 to 20 kA/m by applying 795.8 kA/m, the saturation magnetization is from 50 to 200 $Am^2/kg$, and the residual magnetization is from 1 to 20 $Am^2/kg$. The amount of the magnetic material added is preferably from 4 to 200 mass %, more preferably from 10 to 170 mass % and further preferably from 20 to 150 mass %, based on 100 mass % of the binder resin.

Meanwhile, the toner of the present invention may be used by partially adding as necessary, for example, polyvinyl chloride, polyvinyl acetate, polyester, polyvinyl butyral, polyurethane, polyamide, polystyrene, rosin, polymerized rosin, modified rosin, terpene resin, phenolic resin, aromatic petroleum resin, vinyl chloride resin, styrene-butadiene resin, styrene-(meth)acrylic copolymer, chromane-indene resin, melamine resin or the like, in the ranges in which the effect of the present invention is not hindered.

For the purpose of improving pigment dispersion, a coloring agent may be dispersed in the binder resin or the raw material resin in advance to prepare a so-called masterbatch, and the masterbatch may be added to the toner. Specifically, a coloring agent of 20 to 60 mass % and a resin component of 80 to 40 mass % are mixed in the powder state, and the resulting mixture is kneaded with a twin screw kneader, an open roll kneader, or a batch kneader such as a pressure kneader, and the kneaded mixture followed by grinding may be used during production of a toner.

<Surface Treatment Agent>

For the toner of the present invention, a surface treatment agent is preferably present between the toner and a carrier, or between toners by adding a surface treatment agent to the surface of the toner. With the addition of the surface treatment agent, the powder fluidity, storage stability, electrification stability and environmental stability may be improved, and life of a developing agent may also be improved.

As the surface treatment agent, conventionally known surface treatment agents may be used, and examples thereof include fine silica powder, fine titanium oxide powder and hydrophobically modified products. As fine silica powder, there may be used wet silica, dry silica, and a complex of dry silica and metal oxide. Fine silica powder subjected to hydrophobizing treatment with an organic silicon compound or the like may be further used. As the hydrophobizing treatment, there may be mentioned, for example, a method of treating fine silica powder generated by vapor-phase oxidation of a silicon halogenated compound with a silane compound and with an organic silicon compound, and the like. Examples of the silane compound used for the hydrophobizing treatment include hexamethyl disilazane, trimethyl silane, trimethyl chlorosilane, trimethyl ethoxysilane, dimethyl dichlorosilane, methyl trichlorosilane, allyldimethyl chlorosilane, allylphenyl dichlorosilane, benzyldimethyl chlorosilane, bromomethyl dimethylchlorosilane, α-chloroethyl trichlorosilane, β-chloroethyl trichlorosilane, chloromethyl dimethylchlorosilane, triorganosilyl mercaptan, trimethylsilyl mercaptan, triorganosilyl acrylate, vinyldimethyl acetoxysilane, dimethyldiethoxy silane, dimethyldimethoxy silane, diphenyldiethoxy silane, hexamethyl disiloxane, 1,3-divinyl tetramethyl disiloxane, 1,3-diphenyl tetramethyl disiloxane and the like. Examples of the organic silicon compound used for the hydrophobizing treatment include silicone oils such as dimethyl silicone oil, methylphenyl silicone oil, α-methyl styrene-modified silicone oil, chlorophenyl silicone oil, fluorine-modified silicone oil and the like. Furthermore, fine titanium oxide powder subjected to oil treatment and fine particle of a vinyl resin of from 0.03 to 1 μm may also be used.

As the surface treatment agent in addition thereto, there may also be used a lubricant such as polyethylene fluoride, zinc stearate and polyvinylidene fluoride; an abrasive such as cerium oxide, silicon carbide, strontium titanate, magnetic powder, alumina and the like; and a conductive grant agent such as carbon black, zinc oxide, antimony oxide, tin oxide and the like. As the shape of the surface treatment agent, there may be used various shapes such as a particle having a small particle diameter of equal to or less than 100 nm, a particle having a large particle diameter of equal to or more than 100 nm, octahedron shape, hexahedron shape, needle shape, fiber shape and the like. The surface treatment agents may be used singly or in combination of two or more kinds.

The amount of the surface treatment agent added is preferably from 0.1 to 10 mass parts and more preferably from 0.1 to 5 mass parts in 100 mass parts of the toner.

<Carrier>

When the toner of the present invention is used as a two-component developing agent, conventionally known carriers may be used as a carrier. For example, there may be used particles having a number average particle diameter of 15 to 300 μm composed of metals such as surface-oxidated iron or non-oxidated iron, cobalt, manganese, chromium, copper, zinc, nickel, magnesium, lithium or rare earth, and alloys thereof or oxides. As the carrier, there may be used carriers with its surface coated with a styrene resin, an acrylic resin, a silicone resin, a polyester resin, a fluorine resin or the like. Furthermore, there may be used magnetic carriers having a magnetic microparticle dispersed core obtained by dispersing magnetic microparticles in the resin and a coating layer containing a coating resin to be applied on the surface of the magnetic microparticle dispersed core.

The resulting toner according to the present invention may be applied to various known development methods. Examples include, though not restricted to, a cascade development method, a magnetic brush method, a powder cloud development method, a touch-down development method, a so-called micro-toning development method using, as a carrier, a magnetic toner produced by a pulverizing method, and a so-called bipolar magnetic toner development method in which a required amount of toner charges is obtained by the frictional electrification between magnetic toners. The resulting color toner according to the present invention may also be applied to various cleaning methods such as a conventionally known fur brush method, a blade method and the like. Furthermore, the resulting color toner according to the present invention may be applied to various conventionally known fixing methods. Concrete examples thereof include an oil-free heat roll fixing method, an oil-coated heat roll fixing method, a thermal belt fixing method, a flash fixing method, an oven fixing method, a pressure fixing method and the like. It may also be applied to a fixing apparatus using an electromagnetic induction heating method. Furthermore, it may also be applied to an image forming method involving an intermediate transfer step.

EXAMPLES

The present invention is now illustrated in detail below with reference to Examples. However, the present invention is not restricted to these Examples. Furthermore, methods of measuring and judging data areas follows. In Tables, St represents styrene, Mac represents methacrylic acid, BA represents n-butyl acrylate, and GMA represents glycidyl methacrylate.

<Acid Value>

The acid value (AV) in the Example was calculated in the following manner. An accurately weighed sample was dissolved in a mixed solvent of xylene and n-butanol of 1:1 (mass ratio). The solution was titrated with alcohol of N/10 potassium hydroxide prepared in advance by adding 7 g of special class potassium hydroxide to 5 g of ion exchange water, pouring first class ethyl alcohol to obtain 1 L (liter) of solution, and then titrating with N/10 hydrochloric acid and 1% phenolphthalein solution to obtain the titer-F. Then, its titration amount was used to calculate the acid value according to the following equation.

$$\text{Acid value (mgKOH/q)} = (\text{N/10 KOH titration amount (ml)} \times F \times 5.61)/(\text{sample(g)} \times 0.01)$$

<Epoxy Value>

The epoxy value was measured in the following procedure. 0.2 to 5 g of a resin sample was weighed accurately and put into a 200-ml Erlenmeyer flask, and then 25 ml of dioxane was added thereto and dissolved therein. 25 ml of a 1/5 normal hydrochloric acid solution (dioxane solvent) was added thereto, and the resulting solution was sealed, fully mixed, and then allowed to stand for 30 minutes. Next, 50 ml of a mixed solution of toluene and ethanol of 1:1 (volume ratio) was added thereto, and then the reaction solution was titrated with a 1/10 normal aqueous sodium hydroxide solution using cresol red as an indicator. Based on the titration results, the epoxy value (Eq/100 g) was calculated according to the following equation.

$$\text{Epoxy value}(Eq/100\text{ g})=[(B-S)\times N\times F]/(10\times W)$$

Herein, W refers to the amount of collected sample (g), B refers to the amount of the aqueous sodium hydroxide solution (ml) required for a blank test, S refers to the amount of the aqueous sodium hydroxide solution (ml) required for the test of the sample, N refers to the normality of the aqueous sodium hydroxide solution, and F refers to the titer of the aqueous sodium hydroxide solution.

<Molecular Weight>

The peak molecular weight in the Example (excluding the molecular weight of the saturated crystalline polyester resin (SC)) was obtained by the GPC (gel permeation chromatography) method, and is a molecular weight calculated with reference to a calibration curve produced by the use of the monodispersed standard polystyrene. The measurement conditions are as follows.

GPC apparatus: SHODEX (registered trademark) GPC SYSTEM-21 (Showa Denko K.K.)

Detector: SHODEX (registered trademark) RI SE-31 (Showa Denko K.K.)

Column: SHODEX (registered trademark) GPC KF-G×1+GPC KF-807L×3+GPC KF-800D×1 (Showa Denko K.K.) (serially connected in this order)

Solvent: tetrahydrofuran (THF)

Flow rate: 1.2 ml/min

Sample concentration: 0.002 g-resin/ml-THF

Injected amount: 100 μL

The component insoluble in THF was removed from the sample solution by means of a filter right before the measurement. To measure the molecular weight of a toner, 10 mass parts of the toner was fully dissolved in 90 mass parts of THF, and then 50 mass parts of SIMGON talc and 50 mass parts of titanium oxide (CR-95) were added thereto for carrying out centrifugation. The resulting supernatant liquid was adjusted to a prescribed concentration for measuring the molecular weight.

Meanwhile, the molecular weight of the saturated crystalline polyester resin (SC) was also obtained by the GPC (gel permeation chromatography) method, and is a molecular weight calculated with reference to a calibration curve produced by the use of the monodispersed standard polystyrene. The measurement conditions are as follows.

GPC apparatus: GPC manufactured by Waters Corporation

Detector: 2414 manufactured by Waters Corporation

Column: SHODEX (registered trademark) LF-G×1+LF-804×1 (Showa Denko K.K.) (serially connected in this order)

Solvent: chloroform

Flow rate: 1.0 ml/min

Sample concentration: 0.001 g-resin/ml-chloroform

Injected amount: 100 μL

The component insoluble in chloroform was removed from the sample solution by means of a filter right before the measurement.

In the present invention, the molecular weight of the main peak was determined by the above method as a molecular weight.

<Glass Transition Temperature (Tg) and Melting Point>

Tg in the Example was measured using DSC-20 (a product of Seiko Instruments Inc.) according to differential scanning calorimetry (DSC). About 10 mg of a sample was subjected to temperature elevation from room temperature to 200 degrees centigrade at a rate of 30 degrees centigrade/min, and this sample was air-cooled under the environment of 20 degrees centigrade. Thereafter, the sample was measured in the temperature range of −20 to 200 degrees centigrade at a temperature elevation rate of 10 degrees centigrade/min to obtain a curve; in the curve, an intersection between the base line and the inclined line of the endothermic peak was determined; and the Tg of the sample was determined from the intersection. Also, the melting points of the releasing agent and the crystalline polyester resin were determined from the endothermic peak by the use of the above apparatus.

<Confirmation of Dispersion State of SC in SN>

Using a transmission electron microscope H-7000 (a product of Hitachi Ltd.), the dispersion state of the polyester resin was confirmed at a magnification of ×60,000. When a measurement sample was a binder rein, the binder resin was trimmed, surface-developed, and then dyed with $RuO_4$, whereby an ultra thin film piece was prepared, observed and judged under the following evaluation standard. When a measurement sample was a toner, the toner was wrapped with an epoxy resin and was observed in the same manner as in the resin.

Evaluation Standard

A: A striped structure derived from a crystal structure was confirmed in the island phase of the polyester resin C: A striped structure derived from a crystal structure was not confirmed in the island phase of the polyester resin <THF Insoluble Content>

The THF insoluble content of the binder resin according to the present invention was obtained in the following manner.

0.4 g of a resin and 39.5 g of THF were fed into a 50-ml lidded glass sample tube, and this sample tube was stirred under conditions of a rotation speed of 50 rpm and a temperature of 22 degrees centigrade for 48 hours, and then allowed to stand at 22 degrees centigrade for 48 hours. Thereafter, 5 g of the supernatant liquid in the sample tube was dried at 150 degrees centigrade for 1 hour and then its weight was measured, and this weight was taken as X g to calculate the THF insoluble content (mass %) according to the following equation.

$$THF\ \underset{(mass\ \%)}{\text{Insoluble}}\ \text{Content} = \frac{(0.4/(0.4+39.5)) - X/5}{0.4/(0.4+39.5)} \times 100$$

For the THF insoluble content of the toner according to the present invention, the amount of the THF soluble content of the toner was measured in the same manner as in the insoluble content of the binder resin and its weight was taken as X g. The amount of the component other than the resin in the toner was taken as Y g and the THF insoluble content (mass %) was calculated according to the following equation.

$$THF\ \underset{(mass\ \%)}{\text{Insoluble}}\ \text{Content} = \frac{1.0-(X+Y)}{1.0-Y} \times 100$$

Confirmation of Dispersion State of Polyester Resin Component

Using a transmission electron microscope H-7000 (a product of Hitachi Ltd.), the dispersion state of the polyester resin was confirmed at a magnification of ×10,000. The observation area was 25.5 μm×16 μm at a magnification of ×10,000.

When a measurement sample was a binder rein, the binder resin was trimmed, surface-developed, and then dyed with $RuO_4$, whereby an ultra thin film piece was prepared, observed and judged under the following evaluation standard.

50 of major axis diameters of the island phase of the polyester resin to be observed were measured, and a mean value thereof was defined as a dispersion diameter.

When a measurement sample was a toner, the toner was kneaded using a twin screw kneader and cooled to collect a coarsely pulverized toner chip, and was wrapped with an epoxy resin and then the dispersion state was observed in the same manner as in the resin.

(Evaluation Standard)

A: Dispersion diameter≤1 μm

B: 1 μm<Dispersion diameter≤2 μm

C: 2 μm<Dispersion diameter

<Evaluation of Fixing Properties>

An unfixed image was formed using a copier produced by remodeling a commercial electrophotographic copier. The unfixed image was fixed using a heat roller fixing apparatus produced by remodeling a fixing section of the commercial copier at a fixing speed of a heat roller of 190 mm/sec at a temperature of 130 degrees centigrade. The resulting fixed image was rubbed 6 times by applying a load of 1.0 kgf using a sand eraser (a product of Tombow Pencil Co., Ltd.), and the image densities before and after the rubbing test were measured using a Macbeth reflection densitometer. The image density after the rubbing test image density before the rubbing test×100 was taken as the change ratio. The change ratios were measured in the same manner by changing the image densities, and the lowest numerical value of the change ratios was calculated as a fixing ratio which was then determined on the basis of the following evaluation standard. Incidentally, the heat roller fixing apparatus used herein had no silicone oil feeder. The environmental conditions were under normal temperature and normal pressure (temperature: 22 degrees centigrade, relative humidity: 55%).

(Evaluation Standard)

A: 60%≤Fixing Ratio

B: 55%<Fixing Ratio<60%

C: Fixing Ratio≤55%

<Offset Resistance>

The offset resistance was evaluated as follows according to the above measurement of evaluation of fixing properties. That is, after an unfixed image was formed using the above copier; the toner image was fixed using the above heat roller fixing apparatus; and the appearance of toner staining on the non-image portion was examined. This operation was repeated by gradually increasing the set temperature of the heat roller of the heat roller fixing apparatus from 130 to 250 degrees centigrade at intervals of 5 degrees centigrade. The upper limit of the set temperature at which toner staining did not appear was taken as the temperature of offset resistance. The atmosphere of the above copier was a temperature of 22 degrees centigrade and a relative humidity of 55%.

(Evaluation Standard)

A: 240 degrees centigrade≤Offset Resistance

B: 220 degrees centigrade≤Offset Resistance<240 degrees centigrade

C: Offset Resistance<220 degrees centigrade

<Storage Stability>

In order to accelerate detachment of the saturated crystalline polyester resin (SC) from the toner, 10 g of the toner was fed into a 100-ml lidded glass sample tube under the conditions of a temperature of 22 degrees centigrade and a relative humidity of 55%; this sample tube was stirred at a rotation speed of 50 rpm for 48 hours; and pretreatment of the toner was carried out. Subsequently, 5 g of the toner was allowed to stand under the environmental conditions of a temperature of 50 degrees centigrade and a relative humidity of 60% for 48 hours. The resulting toner was placed on a 150-mesh sieve and then was vibrated for 30 seconds using a powder tester (Hosokawa Powder Technology Research Institute) with the scale of a variable resistor set at 3; and the mass of the toner remained on the 150-mesh sieve after the vibration was measured and a residual mass ratio was determined.

(Evaluation Standard)

A: Residual Mass Ratio<45%

B: 45%≤Residual Mass Ratio<65%

C: 65%≤Residual Mass Ratio

Production Example of Glycidyl Group-Containing Vinyl Resin (E)

Production Example E-1

50 mass parts of xylene was fed into a flask purged with nitrogen and the resulting material was heated. Under xylene reflux, a mixed solution obtained by previous mixing 0.5 mass parts of di-t-butylperoxide with 100 mass parts of the monomer as described in Table 1 for dissolving was continuously added over 5 hours, and further continuously refluxed for 1 hour. Thereafter, while the internal temperature was maintained at 130 degrees centigrade, 0.5 mass parts of di-t-butylperoxide was added thereto and the reaction was continued for 2 hours to obtain a polymerization solution. The resulting polymerization solution was flashed at 160 degrees centigrade in a vessel under 1.33 kPa for removing a solvent or the like to obtain a resin E-1. The physical properties thereof are shown in Table 1.

TABLE 1

Glycidyl group-containing resin/Crosslinking agent E

| Name | Monomer composition | | | | | Physical properties | |
|---|---|---|---|---|---|---|---|
| | | | | | | Peak | Epoxy |
| of resin | St mass % | BA mass % | Mac mass % | GMA mass % | Total mass % | MW $\times 10^4$ | value Eq/100 g |
| E-1 | 77.0 | 20.0 | 0.0 | 3.0 | 100 | 5.1 | 0.021 |

Production Examples of Low Molecular Weight Vinyl Resin (L)

Production Example L-1

75 mass parts of xylene was fed into a flask purged with nitrogen and the resulting material was heated. Under xylene reflux, a mixed solution obtained by previous mixing 2.5 mass parts of t-butylperoxy-2-ethyl hexanoate with 100 mass parts of the monomer as described in Table 2 for dissolving was continuously added over 5 hours, and further continuously refluxed for 1 hour. Thereafter, while the internal temperature was maintained al, 98 degrees centigrade, 0.5 mass parts of t-butylperoxy-2-ethyl hexanoate was further added thereto and the reaction was continued for 1 hour, and 0.5 mass parts of t-butylperoxy-2-ethyl hexanoate was further added thereto and the reaction was continued for 2 hours to obtain a polymerization solution L-1. The physical properties thereof are shown in Table 2.

Production Example L-2

75 mass parts of xylene was fed into a flask purged with nitrogen and the resulting material was heated. Under xylene reflux, a mixed solution obtained by previous mixing 12 mass parts of t-butylperoxy-2-ethyl hexanoate with 100 mass parts of the monomer as described in Table 2 for dissolving was continuously added over 5 hours, and further continuously refluxed for 1 hour. Thereafter, while the internal temperature was maintained at 98 degrees centigrade, 0.3 mass parts of t-butylperoxy-2-ethyl hexanoate was further added thereto and the reaction was continued for 1 hour, and 0.5 mass parts of t-butylperoxy-2-ethyl hexanoate was further added thereto and the reaction was continued for 2 hours to obtain a polymerization solution L-2. The physical properties thereof are shown in Table 2.

Production Example L-3

100 mass parts of xylene was fed into a flask purged with nitrogen and the resulting material was heated. Under xylene reflux, a mixed solution obtained by previous mixing 10 mass parts of t-butylperoxy-2-ethyl hexanoate with 100 mass parts of the monomer as described in Table 2 for dissolving was continuously added over 5 hours, and further continuously refluxed for 1 hour. Thereafter, while the internal temperature was maintained at 98 degrees centigrade, 0.5 mass parts of t-butylperoxy-2-ethyl hexanoate was further added thereto and the reaction was continued for 1 hour, and 0.5 mass parts of t-butylperoxy-2-ethyl hexanoate was further added thereto and the reaction was continued for 2 hours to obtain a polymerization solution L-3. The physical properties thereof are shown in Table 2.

TABLE 2

| Low molecular weight vinyl resin (L) | | | | | |
|---|---|---|---|---|---|
| | Monomer composition | | | Physical properties | |
| Name of resin | St mass % | BA mass % | Mac mass % | Peak MW $\times 10^4$ | AV KOHmg/g |
| L-1 | 79.0 | 20.0 | 1.0 | 1.4 | 6.5 |
| L-2 | 100.0 | | | 0.4 | 0.0 |
| L-3 | 93.0 | 6.0 | 1.0 | 0.5 | 6.5 |

Production Example of High Molecular Weight Vinyl Resin (H)

Production Example H-1

100 mass parts of monomers as illustrated in Table 3 was fed into a flask purged with nitrogen. The internal temperature was elevated to 120 degrees centigrade and kept at the same temperature, and bulk polymerization was carried out for 8 hours. Subsequently, 30 mass parts of xylene was added thereto and the temperature was elevated to 130 degrees centigrade. 0.3 mass parts of divinylbenezene, 0.1 mass part of di-t-butylperoxide and 50 mass parts of xylene previously mixed and dissolved were continuously added over 4 hours while maintaining the internal temperature of the flask at 130 degrees centigrade, and then the reaction was continued for 1 hour. 0.2 mass parts of di-t-butylperoxide was added thereto and the reaction was continued for 2 hours. 0.2 mass parts of di-t-butylperoxide was further added thereto and the reaction was continued for 2 hours, whereby the polymerization was completed to obtain a polymerization solution H-1. The physical properties thereof are shown in Table 3.

TABLE 3

| High molecular weight vinyl resin (H) | | | | | | | |
|---|---|---|---|---|---|---|---|
| | | | | | | Physical properties | |
| Name | Monomer composition | | | | | Peak | |
| of resin | St mass % | BA mass % | Mac mass % | GMA mass % | Total mass % | MW $\times 10^4$ | AV KOHmg/g |
| H-1 | 82.0 | 15.5 | 2.5 | 0.0 | 100.0 | 22 | 16.3 |

Production Examples of Non-crystalline Polyester Resin (SN) and Saturated Crystalline Polyester Resin (SC)

Production Example SN-1

A 4-necked flask was equipped with a reflux condenser, a water-separating unit, a nitrogen gas inlet tube, a thermometer and a stirrer. Thereinto were fed an alcohol component and a carboxylic acid component with feeding compositions as indicated in Table 4. Thereinto was fed 0.3 mass parts of dibutyltin oxide, based on the total amount of 100 mass parts of the alcohol component and the carboxylic acid component. The reaction was carried out for 8 hours by heating the flask to 180 to 220 degrees centigrade while introducing nitrogen into the flask. Thereafter, the reaction was further carried out under a reduced pressure of equal to or less than 8.0 kPa for 1 hour to carry out dehydrative polycondensation. The resulting resin was taken out of the flask, cooled and ground to obtain a non-crystalline polyester resin SN-1. The physical properties thereof are shown in Table 4. Tg of SN-1 was 61 degrees centigrade. In Table 4, KB300 represents a bisphenol A-propylene oxide adduct (a product of Mitsui Chemicals, Inc.).

Production Example SN-2

Dehydrative polycondensation were carried out in the same manner as in Production Example SN-1, except that feeding compositions as indicated in Table 4 were used. The resulting resin was taken out of the flask, cooled and ground to obtain a non-crystalline polyester resin SN-2. The physical properties thereof are shown in Table 4. Tg of SN-2 was 59 degrees centigrade.

Production Example SC-1

A 4-necked flask was equipped with a reflux condenser, a water-separating unit, a nitrogen gas inlet tube, a thermometer and a stirrer. Thereinto were fed an alcohol component and a carboxylic acid component with feeding compositions as indicated in Table 4. Thereinto was fed 0.15 mass parts of a 2-propanol solution of titanium lactate (concentration: 45%) (Orgatics TC-310, a product of Matsumoto Chemical Industry Co., Ltd.), based on the total amount of 100 mass parts of the alcohol component and the carboxylic acid component. The reaction was carried out at 150 degrees centigrade for 2 hours while introducing nitrogen into the flask, and then the reaction was carried out for 5 hours by heating the flask to 220 degrees centigrade. Thereafter, the reaction was further carried out under a reduced pressure of equal to or less than 8.0 kPa for 2 hours to carryout dehydrative polycondensation. The resulting resin was taken out of the flask, cooled and ground to obtain a saturated crystalline polyester resin SC-1. The physical properties thereof are shown in Table 4.

Production Examples SC-2 to SC-4

Saturated crystalline polyester resins of SC-2 to SC-4 were obtained in the same manner as in Production Example SC-1 with feeding compositions as indicated in Table 4. The physical properties thereof are shown in Table 4.

Production Example SC-5

A 4-necked flask was equipped with a reflux condenser, a water-separating unit, a nitrogen gas inlet tube, a thermometer and a stirrer. Thereinto were fed an alcohol component and a carboxylic acid component with feeding compositions as indicated in Table 4. Thereinto were fed 0.15 mass parts of a 2-propanol solution of titanium lactate (concentration: 45%) (Orgatics TC-310, a product of Matsumoto Chemical Industry Co., Ltd.) and 0.2 mass parts of hydroquinone, based on the total amount of 100 mass parts of the alcohol component and the carboxylic acid component. The reaction was carried out at 150 degrees centigrade for 2 hours while introducing nitrogen into the flask, and then the reaction was carried out for 5 hours by heating the flask to 220 degrees centigrade. Thereafter, the reaction was further carried out under a reduced pressure of equal to or less than 8.0 kPa for 2 hours to carry out dehydrative polycondensation. The resulting resin was taken out of the flask, cooled and ground to obtain an unsaturated crystalline polyester resin SC-5. The physical properties thereof are shown in Table 4.

TABLE 4

Non-crystalline polyester (SN) and saturated crystalline polyester (SC)

| | Monomer composition Alcohol component | | | | |
|---|---|---|---|---|---|
| Name of resin | Ethylene glycol mole % | 1,4-butanediol mole % | 1,6-hexanediol mole % | Triethylene glycol mole % | KB300 mole % |
| SN-1 | | | | | 100 |
| SN-2 | 64 | | | 8 | 28 |
| SC-1 | | 100 | | | |
| SC-2 | | 100 | | | |
| SC-3 | | 100 | | | |
| SC-4 | | 100 | | | |
| SC-5 | | | 100 | | |

| | Monomer composition Carboxylic acid component | | | | | | |
|---|---|---|---|---|---|---|---|
| Name of resin | Succinic acid mole % | Adipic acid mole % | Sebacic acid mole % | Fumaric acid mole % | Isophthalic acid mole % | Terephthalic acid mole % | Benzoic acid mole % |
| SN-1 | | | | | 106 | | 14 |
| SN-2 | | | | | | 102 | 6 |
| SC-1 | 98 | 8 | | | | | |
| SC-2 | 106 | | | | | | |
| SC-3 | 77 | 32 | | | | | |
| SC-4 | | | 109 | | | | |
| SC-5 | | | | 106 | | | |

| | Physical properties | | | |
|---|---|---|---|---|
| Name of resin | Melting point Degrees centigrade | Peak MW $\times 10^4$ | Acid value KOHmg/g | Ester group concentration mmol/g |
| SN-1 | — | 0.5 | 30 | 3.8 |
| SN-2 | — | 0.7 | 26 | 6.7 |
| SC-1 | 105 | 1.0 | 37 | 11.0 |
| SC-2 | 113 | 1.1 | 37 | 11.2 |
| SC-3 | 81 | 0.8 | 53 | 10.5 |
| SC-4 | 61 | 1.1 | 41 | 7.2 |
| SC-5 | 111 | 0.9 | 38 | 9.7 |

* KB300: bisphenol A-propylene oxide adduct (a product of Mitsui Chemicals, Inc.)

Production Examples of Mixture (S) of Non-Crystalline Polyester Resin (SN), Saturated Crystalline Polyester Resin (SC) and Fatty Acid Metal Salt Production Example S-1

A 4-necked flask was equipped with a nitrogen gas inlet tube, a thermometer and a stirrer. Thereinto were fed a non-crystalline polyester resin (SN), a saturated crystalline polyester resin (SC) and a fatty acid metal salt with feeding compositions as indicated in Table 5. The resulting material was heated to 150 degrees centigrade while introducing nitrogen into the flask and was mixed under a normal pressure for 30 minutes. Then, the resulting mixture was taken out of the flask, cooled and ground to obtain a mixture S-1 of a non-crystalline polyester resin (SN), a saturated crystalline polyester resin (SC) and a fatty acid metal salt. In Table 5, the amount of the fatty acid metal salt added is a numerical value when the total amount of the non-crystalline polyester resin (SN) and the saturated crystalline polyester resin (SC) is 100 mass %.

In Table 5, mass % each of the saturated crystalline polyester resin (SC) and the non-crystalline polyester resin (SN) represents mass % based on the total amount (100 mass %) of SC and SN. In Table 5, the unit of the amount of the fatty acid metal salt added is represented by mass % based on the total amount (100 mass %) of SC and SN.

TABLE 5

Mixture of non-crystalline polyester (SN) and saturated crystalline polyester (SC)

| Name of resin | Polyester: Crystalline polyester SC Type | Polyester: Crystalline polyester SC mass % | Polyester: Non-crystalline polyester SN Type | Polyester: Non-crystalline polyester SN mass % | Fatty acid metal salt Type | Fatty acid metal salt Added amount mass % |
|---|---|---|---|---|---|---|
| S-1 | SC-1 | 50 | SN-1 | 50 | Zinc stearate | 3.0 |
| S-2 | SC-1 | 35 | SN-1 | 65 | Zinc stearate | 3.0 |
| S-3 | SC-1 | 80 | SN-1 | 20 | Zinc stearate | 3.0 |
| S-4 | SC-1 | 50 | SN-1/SN-2 | 25/25 | Zinc stearate | 3.0 |
| S-5 | SC-1 | 50 | SN-2 | 50 | Zinc stearate | 3.0 |
| S-6 | SC-2 | 50 | SN-1 | 50 | Zinc stearate | 3.0 |
| S-7 | SC-3 | 50 | SN-1 | 50 | Zinc stearate | 3.0 |
| S-8 | SC-1 | 50 | SN-1 | 50 | Calcium stearate | 3.0 |
| S-9 | SC-1 | 50 | SN-1 | 50 | Zinc stearate | 1.0 |
| S-10 | SC-1 | 50 | SN-1 | 50 | — | 0.0 |
| S-11 | SC-1 | 100 | — | — | Zinc stearate | 6.0 |
| S-12 | — | — | SN-1 | 100 | Zinc stearate | 6.0 |
| S-13 | SC-4 | 50 | SN-1 | 50 | Zinc stearate | 3.0 |
| S-14 | SC-5 | 50 | SN-1 | 50 | Zinc stearate | 3.0 |

Production Examples S-2 to S-9, S-13 and S-14

Mixtures of a non-crystalline polyester resin (SN), a saturated crystalline polyester resin (SC) and a fatty acid metal salt of S-2 to S-9, S-13 and S-14 were obtained in the same manner as in Production Example S-1 with feeding compositions as indicated in Table 5.

Production Example S-10

A 4-necked flask was equipped with a nitrogen gas inlet tube, a thermometer and a stirrer. Thereinto were fed a non-crystalline polyester resin (SN) and a saturated crystalline polyester resin (SC) with feeding compositions as indicated in Table 5. The resulting material was heated to 150 degrees centigrade while introducing nitrogen into the flask and was mixed under a normal pressure for 30 minutes. Thereafter, the resulting mixture was taken out of the flask, cooled and ground to obtain a mixture S-10 of a non-crystalline polyester resin (SN) and a saturated crystalline polyester resin (SC).

Production Example S-11

A 4-necked flask was equipped with a nitrogen gas inlet tube, a thermometer and a stirrer. Thereinto were fed a saturated crystalline polyester resin (SC) and a fatty acid metal salt with feeding compositions as indicated in Table 5. The resulting material was heated to 150 degrees centigrade while introducing nitrogen into the flask and was mixed under a normal pressure for 30 minutes. Thereafter, the resulting mixture was taken out of the flask, cooled and ground to obtain a mixture S-11 of a saturated crystalline polyester resin (SC) and a fatty acid metal salt.

Production Example S-12

A 4-necked flask was equipped with a nitrogen gas inlet tube, a thermometer and a stirrer. Thereinto were fed a non-crystalline polyester resin (SN) and a fatty acid metal salt with feeding compositions as indicated in Table 5. The resulting material was heated to 150 degrees centigrade while introducing nitrogen into the flask and was mixed under a normal pressure for 30 minutes. Thereafter, the resulting mixture was taken out of the flask, cooled and ground to obtain a mixture S-12 of a non-crystalline polyester resin (SN) and a fatty acid metal salt.

Production Examples of Carboxyl Group-containing Vinyl Resin (C)

Production Example C-1

A high molecular weight vinyl resin (H) and a low molecular weight vinyl resin (L) were mixed with feeding compositions as indicated in Table 6. Thereafter, under xylene reflux, the resulting mixture was mixed for 30 minutes and was flashed at 190 degrees centigrade in a vessel under 1.33 kPa for removing a solvent or the like to obtain a resin C-1. The physical properties thereof are shown in Table 6.

Production Examples C-2 and C-3

Resins of C-2 and C-3 were obtained in the same manner as in Production Example C-1 with feeding compositions as indicated in Table 6. The physical properties thereof are shown in Table 6.

Production Example C-4

A high molecular weight vinyl resin (H), a low molecular weight vinyl resin (L) and FT100 (a product of Nippon Seiro Co., Ltd.) as a releasing agent were mixed with feeding compositions as indicated in Table 6, and further 0.5 mass parts of a styrene-ethylene-butylene-styrene block copolymer (SEBS) (product name: Kraton G1652; a product of Kraton Polymers Japan, Ltd.) as an additive was mixed thereto, based on the total amount of 100 mass parts of the high molecular weight vinyl resin (H) and the low molecular weight vinyl resin (L). Thereafter, under xylene reflux, the resulting mixture was mixed for 30 minutes and was flashed at 190 degrees centigrade in a vessel under 1.33 kPa for removing a solvent or the like to obtain a resin C-4. The physical properties thereof are shown in Table 6.

Production Example C-5

A resin C-5 was obtained in the same manner as in Production Example C-4, except that the releasing agent was changed to WEP-5 (a product of NOF Corporation). The physical properties thereof are shown in Table 6.

TABLE 6

| Carboxyl group-containing vinyl resin (C) | | | | | | | | |
|---|---|---|---|---|---|---|---|---|
| | Raw material composition | | | | | | | |
| Name of resin | High molecular weight resin H Type | mass % | Low molecular weight resin L Type | mass % | Releasing agent (based on H + L = 100%) Type | mass % | Peak molecular weight $\times 10^4$ | Acid value KOHmg/g |
| C-1 | H-1 | 25 | L-1 | 75 | — | — | 1.4 | 8.9 |
| C-2 | H-1 | 34 | L-1/L-2 | 38/38 | — | — | 0.6 | 8.0 |
| C-3 | H-1 | 45 | L-3 | 55 | — | — | 0.5 | 10.9 |
| C-4 | H-1 | 25 | L-1 | 75 | FT100 | 5.0 | 1.4 | 8.5 |
| C-5 | H-1 | 25 | L-1 | 75 | WEP-5 | 5.0 | 1.4 | 8.5 |

Production Examples of Binder Resin (R)

Production Examples R-1 to R-26

Respective resins were mixed such that the ratios of the carboxyl group-containing vinyl resin (C), the glycidyl group-containing vinyl resin (E), and the mixture (S) of a non-crystalline polyester resin (SN), a saturated crystalline polyester resin (SC) and a fatty acid metal salt or the saturated crystalline polyester resin (SC) alone as indicated in Table 5 were the ratios as indicated in Table 8. Thereafter, the resulting mixture was kneaded and reacted at 25 kg/hr and a motor rotation speed of 1,400 rpm by the use of a twin screw kneader (KEXN S-40 type, a product of Kurimoto Ltd.) with its temperature set at the reaction temperature as described in Table 8. This kneaded product was rapidly cooled using a steel belt cooler (NR3-Hi double cooler, a product of Nippon Belting Co., Ltd.) under conditions of a cooling water temperature of 10 degrees centigrade, the amount of cooling water of 90 L/min and a belt speed of 6 m/min, and then was ground to obtain binder resins of R-1 to R-26. The physical properties thereof are shown in Table 8. Incidentally, in calculation of respective ratios and M contents in the configuration of the binder resin in Table 8, the mass of C (carboxyl group-containing vinyl resin (C)) does not include the mass of the releasing agent. Meanwhile, when a fatty acid metal salt was contained in the mixture (S) of a non-crystalline polyester resin (SN), a saturated crystalline polyester resin (SC) and a fatty acid metal salt as described in Table 5, mass % of the polyester resin mixture in the raw material composition of the binder resin in Table 8 was calculated by excluding the mass of the fatty acid metal salt.

In Table 8, mass % each of the carboxyl group-containing vinyl resin (C) and the glycidyl group-containing vinyl resin (E) (non-crystalline polyester resin (SN) and saturated crystalline polyester resin (SC)) represents mass %, based on the total amount (100 mass parts) of C, E and SN+SC. Furthermore, in Table 8, mass % each of the fatty acid metal salt and M content represents mass %, based on the total amount (100 mass %) of C, E and SN+SC.

In the production of R-14 and R-15, the carboxyl group-containing vinyl resin (C) containing a releasing agent in advance was used. Accordingly, the releasing agent component in R-14 and R-15 of Table 8 refers to the releasing agent component contained in the carboxyl group-containing vinyl resin (C), and does not mean new addition in the production process of the binder resin (R).

TABLE 7

| Releasing agent/Wax | | | |
|---|---|---|---|
| | Product name | Type | Melting point (Degrees centigrade) |
| FT100 | Nippon Seiro Co., Ltd. | Fisher-Tropsch wax | 98 |
| HNP-10 | Nippon Seiro Co., Ltd. | Paraffin wax | 74 |
| Polywax 1000 | Baker Petrolite Corporation | Polyethylene wax | 113 |
| WEP-5 | NOF Corporation | Ester wax | 86 |
| NP105 | Mitsui Chemicals, Inc. | Polypropylene wax | 140 |

Production Examples of Toner for Electrophotography (T)

Production Examples T-1 to T-26

6 mass % of carbon black (MA100, a product of Mitsubishi Chemical Corporation) as a coloring agent and 0.5 mass % of a charge controlling agent (T-77, a product of Hodogaya Chemical Co., Ltd.) were added to 100 mass % of the binder resin (R), and various releasing agents (described in Table 7) were further added with the ratios as indicated in Table 9. The resulting mixture was mixed by means of a Henschel mixer, and then was kneaded by means of a twin screw kneader (PCM-30 type, a product of Ikegai Corporation) at 120 degrees centigrade of the resin temperature at the discharge portion of the twin screw kneader for 30 seconds of the residence time. Next, after cooling, pulverizing and classifying, 0.5 mass % of hydrophobic fine silica powder (R-812, a product of Nippon Aerosil Co., Ltd.) and 0.2 mass % of hydrophobic titanium oxide (NKT-90, a product of Nippon Aerosil Co., Ltd.) were added to 100 mass % of the toner particles, whereby toners of T-1 to T-26 having a volume median diameter D50 of about 7.5 μm measured using a coulter counter were obtained. The physical properties thereof are shown in Table 9. Incidentally, when the binder resin (R) contains a releasing agent therein, 100 mass % of the binder resin (R) does not include the mass of the releasing agent.

In Table 9, mass % of the releasing agent represents mass %, based on 100 mass % of the binder resin (when a releasing agent is contained, the releasing agent in the binder resin is excluded).

TABLE 8

| Binder resin | | | | | | | |
|---|---|---|---|---|---|---|---|
| | Binder resin raw material composition | | | | | | |
| Name of binder | Carboxyl group-containing resin C (H + L) | | Glycidyl group-containing resin E | | Polyester mixture (SN + SC) | | Reaction temperature Degrees |
| resin | Type | mass % | Type | mass % | Type | mass % | centigrade |
| R-1 | C-1 | 73 | E-1 | 7 | S-1 | 20 | 180 |
| R-2 | C-2 | 73 | E-1 | 7 | S-1 | 20 | 165 |
| R-3 | C-3 | 73 | E-1 | 7 | S-1 | 20 | 150 |
| R-4 | C-1 | 73 | E-1 | 7 | S-2 | 20 | 180 |
| R-5 | C-1 | 73 | E-1 | 7 | S-3 | 20 | 180 |
| R-6 | C-1 | 83 | E-1 | 7 | S-1 | 10 | 180 |
| R-7 | C-1 | 63 | E-1 | 7 | S-1 | 30 | 180 |
| R-8 | C-1 | 73 | E-1 | 7 | S-4 | 20 | 180 |
| R-9 | C-1 | 73 | E-1 | 7 | S-5 | 20 | 180 |
| R-10 | C-1 | 73 | E-1 | 7 | S-6 | 20 | 180 |
| R-11 | C-1 | 73 | E-1 | 7 | S-7 | 20 | 180 |
| R-12 | C-1 | 73 | E-1 | 7 | S-8 | 20 | 180 |
| R-13 | C-1 | 73 | E-1 | 7 | S-9 | 20 | 180 |
| R-14 | C-4 | 73 | E-1 | 7 | S-1 | 20 | 180 |
| R-15 | C-5 | 73 | E-1 | 7 | S-1 | 20 | 180 |
| R-16 | C-1 | 80 | N/A | 0 | S-1 | 20 | 180 |
| R-17 | C-1 | 73 | E-1 | 7 | S-10 | 20 | 180 |
| R-18 | C-1 | 93 | E-1 | 7 | N/A | 0 | 180 |
| R-19 | C-1 | 90 | E-1 | 7 | S-1 | 3 | 180 |
| R-20 | C-1 | 53 | E-1 | 7 | S-1 | 40 | 180 |
| R-21 | C-1 | 83 | E-1 | 7 | S-11 | 10 | 180 |
| R-22 | C-1 | 83 | E-1 | 7 | S-12 | 10 | 180 |
| R-23 | C-1 | 90 | N/A | 0 | S-11 | 10 | 180 |
| R-24 | C-1 | 83 | E-1 | 7 | SC-1 | 10 | 180 |
| R-25 | C-1 | 73 | E-1 | 7 | S-13 | 20 | 180 |
| R-26 | C-1 | 73 | E-1 | 7 | S-14 | 20 | 180 |

| | Binder resin composition | | | | | |
|---|---|---|---|---|---|---|
| | Releasing agent | | | Fatty acid metal salt | | |
| Name of binder | Releasing agent (H + L + E + SN + SC = 100%) | | Melting point Degrees | Fatty acid metal salt (H + L + E + SN + SC = 100%) | | M content (H + L + E + SN + SC = 100%) |
| resin | Type | mass % | centigrade | Type | mass % | mass % |
| R-1 | — | 0.0 | — | Zinc stearate | 0.6 | 0.062 |
| R-2 | — | 0.0 | — | Zinc stearate | 0.6 | 0.062 |
| R-3 | — | 0.0 | — | Zinc stearate | 0.6 | 0.062 |
| R-4 | — | 0.0 | — | Zinc stearate | 0.6 | 0.062 |
| R-5 | — | 0.0 | — | Zinc stearate | 0.6 | 0.062 |
| R-6 | — | 0.0 | — | Zinc stearate | 0.3 | 0.031 |
| R-7 | — | 0.0 | — | Zinc stearate | 0.9 | 0.094 |
| R-8 | — | 0.0 | — | Zinc stearate | 0.6 | 0.062 |
| R-9 | — | 0.0 | — | Zinc stearate | 0.6 | 0.062 |
| R-10 | — | 0.0 | — | Zinc stearate | 0.6 | 0.062 |
| R-11 | — | 0.0 | — | Zinc stearate | 0.6 | 0.062 |
| R-12 | — | 0.0 | — | Calcium stearate | 0.6 | 0.040 |
| R-13 | — | 0.0 | — | Zinc stearate | 0.2 | 0.021 |
| R-14 | FT100 | 3.7 | 98 | Zinc stearate | 0.6 | 0.062 |
| R-15 | WEP-5 | 3.7 | 86 | Zinc stearate | 0.6 | 0.062 |
| R-16 | — | 0.0 | — | Zinc stearate | 0.6 | 0.062 |
| R-17 | — | 0.0 | — | N/A | 0.0 | 0.000 |
| R-18 | — | 0.0 | — | N/A | 0.0 | 0.000 |
| R-19 | — | 0.0 | — | Zinc stearate | 0.1 | 0.009 |
| R-20 | — | 0.0 | — | Zinc stearate | 1.2 | 0.125 |
| R-21 | — | 0.0 | — | Zinc stearate | 0.6 | 0.062 |
| R-22 | — | 0.0 | — | Zinc stearate | 0.6 | 0.062 |
| R-23 | — | 0.0 | — | Zinc stearate | 0.6 | 0.062 |
| R-24 | — | 0.0 | — | N/A | 0.0 | 0.000 |
| R-25 | — | 0.0 | — | Zinc stearate | 0.6 | 0.062 |
| R-26 | — | 0.0 | — | Zinc stearate | 0.6 | 0.062 |

TABLE 8-continued

| Binder resin | | | | | | |
|---|---|---|---|---|---|---|
| | Physical properties | | | | | |
| Name of binder resin | SC Melting point Degrees centigrade | Dispersion state of SC in SN | Tg Degrees centigrade | Peak molecular weight $\times 10^4$ | THF insoluble content mass % | Dispersion state of polyester component |
| R-1 | 105 | A | 59 | 1.2 | 20 | A |
| R-2 | 105 | A | 61 | 0.6 | 17 | A |
| R-3 | 105 | A | 59 | 0.5 | 13 | A |
| R-4 | 105 | A | 58 | 1.2 | 16 | A |
| R-5 | 105 | A | 60 | 1.3 | 24 | A |
| R-6 | 105 | A | 61 | 1.3 | 11 | A |
| R-7 | 105 | A | 58 | 1.1 | 28 | A |
| R-8 | 105 | A | 59 | 1.2 | 20 | A |
| R-9 | 105 | A | 58 | 1.2 | 20 | B |
| R-10 | 113 | A | 59 | 1.2 | 20 | A |
| R-11 | 81 | A | 59 | 1.2 | 20 | A |
| R-12 | 105 | A | 59 | 1.2 | 20 | A |
| R-13 | 105 | A | 59 | 1.2 | 20 | A |
| R-14 | 105 | A | 56 | 1.2 | 24 | A |
| R-15 | 105 | A | 55 | 1.2 | 24 | A |
| R-16 | 105 | A | 59 | 1.2 | 7 | B |
| R-17 | 105 | C | 59 | 1.2 | 11 | B |
| R-18 | N/A | — | 61 | 1.4 | 3 | — |
| R-19 | 105 | A | 60 | 1.4 | 6 | A |
| R-20 | 105 | A | 57 | 1.1 | 34 | B |
| R-21 | 105 | — | 60 | 1.4 | 20 | B |
| R-22 | N/A | — | 60 | 1.2 | 9 | A |
| R-23 | 105 | — | 59 | 1.4 | 7 | C |
| R-24 | 106 | — | 59 | 1.4 | 12 | C |
| R-25 | 56 | C | 39 | 1.2 | 19 | A |
| R-26 | 107 | C | 57 | 1.2 | 22 | A |

Examples 1 to 15 and Comparative Examples 1 to 11

97 mass % of a carrier (F-150, a product of Powdertech Corporation) was mixed to 3 mass % of the toner as described in Table 9 to give a developing agent. Various evaluations were performed. The results are shown in Table 9.

TABLE 9

| Physical properties and evaluation results of toner | | | | |
|---|---|---|---|---|
| Example/ Comparative Example No. | Name of toner | Name of binder resin | Releasing agent | |
| | | | Type | mass % |
| Example 1 | T-1 | R-1 | FT100 | 5 |
| Example 2 | T-2 | R-2 | FT100 | 5 |
| Example 3 | T-3 | R-3 | FT100 | 5 |
| Example 4 | T-4 | R-4 | FT100 | 5 |
| Example 5 | T-5 | R-5 | FT100 | 5 |
| Example 6 | T-6 | R-6 | FT100 | 5 |
| Example 7 | T-7 | R-7 | FT100 | 5 |
| Example 8 | T-8 | R-8 | FT100 | 5 |
| Example 9 | T-9 | R-9 | FT100 | 5 |
| Example 10 | T-10 | R-10 | FT100 | 5 |
| Example 11 | T-11 | R-11 | HNP-100 | 5 |
| Example 12 | T-12 | R-12 | FT100 | 5 |
| Example 13 | T-13 | R-13 | FT100 | 5 |
| Example 14 | T-14 | R-14 | NP105 | 1.4 |
| Example 15 | T-15 | R-15 | Polywax 1000 | 1.4 |
| Comparative Example 1 | T-16 | R-16 | FT100 | 5 |
| Comparative Example 2 | T-17 | R-17 | FT100 | 5 |
| Comparative Example 3 | T-18 | R-18 | FT100 | 5 |
| Comparative Example 4 | T-19 | R-19 | FT100 | 5 |

TABLE 9-continued

| Physical properties and evaluation results of toner | | | | |
|---|---|---|---|---|
| Comparative Example 5 | T-20 | R-20 | FT100 | 5 |
| Comparative Example 6 | T-21 | R-21 | FT100 | 5 |
| Comparative Example 7 | T-22 | R-22 | FT100 | 5 |
| Comparative Example 8 | T-23 | R-23 | FT100 | 5 |
| Comparative Example 9 | T-24 | R-24 | FT100 | 5 |
| Comparative Example 10 | T-25 | R-25 | FT100 | 5 |
| Comparative Example 11 | T-26 | R-26 | FT100 | 5 |

| | Physical properties of toner | | | | |
|---|---|---|---|---|---|
| Example/ Comparative Example No. | SC Melting point Degrees centigrade | Dispersion state of SC in SN | Tg Degrees centigrade | Peak molecular weight $\times 10^4$ | THF insoluble content mass % |
| Example 1 | 105 | A | 55 | 1.2 | 21 |
| Example 2 | 105 | A | 57 | 0.6 | 18 |
| Example 3 | 105 | A | 55 | 0.5 | 15 |
| Example 4 | 105 | A | 54 | 1.2 | 18 |
| Example 5 | 105 | A | 56 | 1.3 | 26 |
| Example 6 | 105 | A | 57 | 1.3 | 12 |
| Example 7 | 105 | A | 54 | 1.1 | 28 |
| Example 8 | 105 | A | 55 | 1.2 | 21 |
| Example 9 | 105 | A | 54 | 1.2 | 21 |
| Example 10 | 113 | A | 55 | 1.2 | 23 |
| Example 11 | 81 | A | 54 | 1.2 | 24 |
| Example 12 | 105 | A | 55 | 1.2 | 21 |
| Example 13 | 105 | A | 55 | 1.2 | 21 |
| Example 14 | 105 | A | 56 | 1.2 | 21 |
| Example 15 | 105 | A | 54 | 1.2 | 21 |
| Comparative Example 1 | 105 | A | 55 | 1.2 | 9 |
| Comparative Example 2 | 105 | C | 55 | 1.2 | 13 |
| Comparative Example 3 | N/A | — | 57 | 1.4 | 6 |
| Comparative Example 4 | 105 | A | 57 | 1.4 | 9 |
| Comparative Example 5 | 105 | A | 53 | 1.1 | 35 |
| Comparative Example 6 | 105 | — | 56 | 1.4 | 20 |
| Comparative Example 7 | N/A | — | 56 | 1.2 | 9 |
| Comparative Example 8 | 105 | — | 55 | 1.4 | 8 |
| Comparative Example 9 | 106 | — | 55 | 1.4 | 14 |
| Comparative Example 10 | 56 | C | 35 | 1.2 | 20 |
| Comparative Example 11 | 107 | C | 53 | 1.2 | 21 |

| | Evaluation results | | | |
|---|---|---|---|---|
| Example/ Comparative Example No. | Dispersion state of polyester component | Fixing properties | Offset resistance | Storage stability |
| Example 1 | A | A | A | A |
| Example 2 | A | A | A | A |
| Example 3 | A | A | A | A |
| Example 4 | A | A | A | A |
| Example 5 | A | A | A | A |
| Example 6 | A | A | A | A |
| Example 7 | A | A | A | B |
| Example 8 | A | A | A | A |
| Example 9 | B | A | A | B |
| Example 10 | A | A | A | A |
| Example 11 | A | A | A | A |

TABLE 9-continued

| Physical properties and evaluation results of toner | | | | |
|---|---|---|---|---|
| Example 12 | A | A | A | A |
| Example 13 | A | A | A | A |
| Example 14 | A | A | A | A |
| Example 15 | A | A | A | A |
| Comparative Example 1 | B | A | C | B |
| Comparative Example 2 | B | A | B | B |
| Comparative Example 3 | — | C | B | A |
| Comparative Example 4 | A | C | B | A |
| Comparative Example 5 | B | A | B | C |
| Comparative Example 6 | B | A | A | C |
| Comparative Example 7 | A | C | A | A |
| Comparative Example 8 | C | A | C | C |
| Comparative Example 9 | C | A | B | C |
| Comparative Example 10 | A | A | A | C |
| Comparative Example 11 | A | B | A | C |

As clear from the results in Table 9, both the binder resin for a toner and the toner using the resin produced according to the present invention were excellent in a balance among various properties.

This application is based on Japanese patent application No. 2010-176788 filed on Aug. 5, 2010, the content of which is incorporated hereinto by reference.

The invention claimed is:

1. A binder resin for a toner comprising a vinyl resin (A), a non-crystalline polyester resin (SN), a saturated crystalline polyester resin (SC), and a metal component (M) containing at least one metal selected from the group consisting of Zn, Ca, Mg, Al and Ba (with the proviso that the metal component excludes metal oxide), wherein the content of said vinyl resin (A) is equal to or more than 65 mass % and equal to or less than 95 mass %, based on the total content of 100 mass % of said vinyl resin (A), said non-crystalline polyester resin (SN) and said saturated crystalline polyester resin (SC), said vinyl resin (A) is composed of a carboxyl group-containing vinyl resin (C), a glycidyl group-containing vinyl resin (E) and a reaction product of the vinyl resins, the ester group concentration of said saturated crystalline polyester resin (SC) is equal to or more than 10.0 mmol/g and equal to or less than 13.5 mmol/g, said non-crystalline polyester resin (SN) is dispersed in an island form in said vinyl resin (A) and said saturated crystalline polyester resin (SC) is contained in the island phase of said non-crystalline polyester resin (SN), said metal component (M) is contained at least in said saturated crystalline polyester resin (SC), and wherein said metal component (M) is added as a fatty acid metal salt represented by the following general formula, $$(C_nH_{2n+1}COO)_m\text{-}M$$

wherein n is an integer of 11 to 22; m is an integer of 2 or 3; and M is a metal selected from Zn, Ca, Mg, Al and Ba.

2. The binder resin for a toner according to claim 1, wherein said non-crystalline polyester resin (SN) has at least an aromatic ring structure.

3. The binder resin for a toner according to claim 1, wherein the melting point of said saturated crystalline polyester resin (SC) is equal to or more than 75 degrees centigrade and equal to or less than 120 degrees centigrade.

4. The binder resin for a toner according claim 1, wherein the glass transition temperature is equal to or more than 50 degrees centigrade and equal to or less than 65 degrees centigrade, the tetrahydrofuran soluble content has a main peak in the molecular weight region of equal to or more than $0.3\times10^4$ and less than $2\times10^4$ in the molecular weight distribution measured by gel permeation chromatography, and the tetrahydrofuran insoluble content is equal to or more than 5 mass % and less than 40 mass %.

5. The binder resin for a toner according to claim 1, wherein the acid value of said saturated crystalline polyester resin (SC) is equal to or more than 25 mgKOH/g and equal to or less than 70 mgKOH/g.

6. The binder resin for a toner according to claim 1, wherein the content of said non-crystalline polyester resin (SN) is equal to or more than 15 mass % and equal to or less than 70 mass %, based on the total content of 100 mass % of said non-crystalline polyester resin (SN) and said saturated crystalline polyester resin (SC).

7. The binder resin for a toner according to claim 1, wherein, for said non-crystalline polyester resin (SN), the ester group concentration is equal to or more than 3.0mmol/g and equal to or less than 7.0 mmol/g, the acid value is equal to or more than 25 mgKOH/g and equal to or less than 70 mgKOH/g, and the tetrahydrofuran soluble content has a main peak in the molecular weight region of equal to or more than $0.3\times10^4$ and less than $1.0\times10^4$ in the molecular weight distribution measured by gel permeation chromatography.

8. The binder resin for a toner according to claim 1, wherein the phase of said saturated crystalline polyester resin (SC) is contained in the phase of said non-crystalline polyester resin (SN).

9. A toner comprising a binder resin for a toner, a coloring agent and a releasing agent, wherein said binder resin for a toner is the binder resin for a toner according to claim 1, at least one of said releasing agents has a melting point of equal to or more than −40 degrees centigrade and equal to or less than 5 degrees centigrade, based on the melting point of the saturated crystalline polyester resin (SC), and the dispersion diameter of the island phase of the non-crystalline polyester resin (SN) in the vinyl resin (A) is equal to or less than 2.0 μm.

10. The toner according to claim 9, wherein the glass transition temperature is equal to or more than 50 degrees centigrade and equal to or less than 65 degrees centigrade, the tetrahydrofuran soluble content has a main peak in the molecular weight region of equal to or more than $0.3\times10^4$ and less than $2\times10^4$ in the molecular weight distribution measured by gel permeation chromatography, and the tetrahydrofuran insoluble content is equal to or more than 5 mass % and less than 40 mass %.

11. A method for producing a binder resin for a toner comprising:

obtaining a mixture of a non-crystalline polyester resin (SN), a saturated crystalline polyester resin (SC) and a metal component (M) containing at least one metal selected from the group consisting of Zn, Ca, Mg, Al and Ba (with the proviso that the metal component excludes metal oxide), and mixing said obtained mixture, a carboxyl group-containing vinyl resin (C) and a glycidyl group-containing vinyl resin (E) in the melt state, wherein said metal component (M) is added as a fatty acid metal salt represented by the following general formula, $$(C_nH_{2n+1}COO)_m\text{-}M$$

wherein n is an integer of 11 to 22; m is an integer of 2 or 3; and M is a metal selected from Zn, Ca, Mg, Al and Ba.

12. A method for producing a toner comprising:

obtaining a binder resin for a toner, and mixing said binder resin for a toner and a coloring agent, in which said binder resin for a toner is obtained in accordance with the production method according to claim 11.

13. A binder resin for a toner comprising a vinyl resin (A), a non-crystalline polyester resin (SN), a saturated crystalline polyester resin (SC), and a metal component (M) containing at least one metal selected from the group consisting of Zn, Ca, Mg, Al and Ba (with the proviso that the metal component excludes metal oxide), wherein the content of said vinyl resin (A) is equal to or more than 65 mass % and equal to or less than 95 mass %, based on the total content of 100 mass % of said vinyl resin (A), said non-crystalline polyester resin (SN) and said saturated crystalline polyester resin (SC), said vinyl resin (A) is composed of a carboxyl group-containing vinyl resin (C), a glycidyl group-containing vinyl resin (E) and a reaction product of the vinyl resins, the ester group concentration of said saturated crystalline polyester resin (SC) is equal to or more than 10.0 mmol/g and equal to or less than 13.5 mmol/g, said non-crystalline polyester resin (SN) is dispersed in an island form in said vinyl resin (A) and said saturated crystalline polyester resin (SC) is contained in the island phase of said non-crystalline polyester resin (SN), said metal component (M) is contained at least in said saturated crystalline polyester resin (SC), said non-crystalline polyester resin (SN) has at least an aromatic ring structure, the phase of said saturated crystalline polyester resin (SC) is contained in the phase of said non-crystalline polyester resin (SN), and wherein said metal component (M) is added as a fatty acid metal salt represented by the following general formula, $$(C_nH_{2n+1}COO)_m\text{-}M$$

wherein n is an integer of 11 to 22; m is an integer of 2 or 3; and M is a metal selected from Zn, Ca, Mg, Al and Ba.

14. A binder resin for a toner comprising a vinyl resin (A), a non-crystalline polyester resin (SN), a saturated crystalline polyester resin (SC), and a metal component (M) containing at least one metal selected from the group consisting of Zn, Ca, Mg, Al and Ba (with the proviso that the metal component excludes metal oxide), wherein the content of said vinyl resin (A) is equal to or more than 65 mass % and equal to or less than 95 mass %, based on the total content of 100 mass % of said vinyl resin (A), said non-crystalline polyester resin (SN) and said saturated crystalline polyester resin (SC), said vinyl resin (A) is composed of a carboxyl group-containing vinyl resin (C), a glycidyl group-containing vinyl resin (E) and a reaction product of the vinyl resins, the ester group concentration of said saturated crystalline polyester resin (SC) is equal to or more than 10.0 mmol/g and equal to or less than 13.5 mmol/g, said non-crystalline polyester resin (SN) is dispersed in an island form in said vinyl resin (A) and said saturated crystalline polyester resin (SC) is contained in the island phase of said non-crystalline polyester resin (SN), said metal component (M) is contained at least in said saturated crystalline polyester resin (SC), said non-crystalline polyester resin (SN) has at least an aromatic ring structure, and said metal component (M) is added as a fatty acid metal salt represented by the following general formula, $$(C_nH_{2n+1}COO)_m\text{-}M$$

wherein n is an integer of 11 to 22; m is an integer of 2 or 3; and M is a metal selected from Zn, Ca, Mg, Al and Ba.

* * * * *